US009142203B2

(12) United States Patent
Watanabe

(10) Patent No.: US 9,142,203 B2
(45) Date of Patent: Sep. 22, 2015

(54) MUSIC DATA GENERATION BASED ON TEXT-FORMAT CHORD CHART

(71) Applicant: YAMAHA CORPORATION, Hamamatsu-shi (JP)

(72) Inventor: Daichi Watanabe, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 14/505,026

(22) Filed: Oct. 2, 2014

(65) Prior Publication Data

US 2015/0096433 A1 Apr. 9, 2015

(30) Foreign Application Priority Data

Oct. 8, 2013 (JP) ..... 2013-210923

(51) Int. Cl.

| | |
|---|---|
| ***G10H 5/00*** | (2006.01) |
| ***G10H 7/00*** | (2006.01) |
| ***G10H 1/38*** | (2006.01) |
| ***G10H 1/00*** | (2006.01) |

(52) U.S. Cl.

CPC ..... *G10H 7/00* (2013.01); *G10H 1/0008* (2013.01); *G10H 1/383* (2013.01); *G10H 2210/005* (2013.01); *G10H 2210/391* (2013.01); *G10H 2210/576* (2013.01)

(58) Field of Classification Search

USPC ..... 84/613, 637
IPC ..... G10H 5/00
See application file for complete search history.

(56) References Cited

U.S. PATENT DOCUMENTS

| | | | | |
|---|---|---|---|---|
| 5,990,407 | A * | 11/1999 | Gannon | 84/613 |
| 6,177,624 | B1 * | 1/2001 | Takahashi et al. | 84/609 |
| 7,034,217 | B2 * | 4/2006 | Pachet | 84/609 |
| 7,447,986 | B2 | 11/2008 | Kikuchi | |
| 7,960,638 | B2 * | 6/2011 | Miyajima et al. | 84/604 |
| 8,097,801 | B2 * | 1/2012 | Gannon | 84/613 |
| 2011/0120288 | A1 * | 5/2011 | Bignell et al. | 84/483.1 |
| 2014/0196592 | A1 * | 7/2014 | Bergman | 84/613 |

FOREIGN PATENT DOCUMENTS

| | | |
|---|---|---|
| JP | 3166455 B2 | 5/2001 |
| JP | 3918580 B2 | 5/2007 |

OTHER PUBLICATIONS

Band-In-A-Box User Manual 2007 Viewed online at http://www.central-manuals.com/instructions_manual_user_guide_software/band_in_a_box.php.*

* cited by examiner

*Primary Examiner* — David Warren
(74) *Attorney, Agent, or Firm* — Rossi, Kimms & McDowell LLP

(57) ABSTRACT

Individual chords and bar lines are extracted from an acquired chord chart described in text. Further, musical time information indicative of a musical time of music data to be generated is acquired, chord progression information is generated by allocating in-bar relative time positions to the extracted individual chords in accordance with the musical time indicated by the acquired musical time information and the extracted bar lines. A chord chart display can be provided based on the generated chord progression information. Further, accompaniment pattern data is acquired, and automatic accompaniment data can be generated by controlling the acquired accompaniment pattern data in accordance with the generated chord progression information.

12 Claims, 7 Drawing Sheets

MUSIC DATA GENERATION BASED ON TEXT-FORMAT CHORD CHART

BACKGROUND

The present invention relates to a music data generation apparatus and a music data generation method for generating chord progression information and generating music data based on the generated chord progression information, and a program for implementing the music data generation method.

There have heretofore been known music data generation apparatus for generating music data. Among examples of such music data generation apparatus is a performance data creation apparatus, in which a plurality of sets of accompaniment style data and sections designated by a user are connected and which, once a chord progression is designated for each of the sets, generates automatic accompaniment data automatically-performable (automatically-playable) automatic accompaniment data by changing as appropriate sound pitches of accompaniment patterns designated by the individual sets of accompaniment style data and sections in the order of the connection (see, for example, Japanese Patent No. 3166455).

Also known is a multimedia information reproduction apparatus, which identifies text code indicative of performance information and text code indicative of lyrics data with reference to event identifiers included in script data including the text code, which converts the text code identified as performance information into performance event information to output the converted performance event information to a MIDI (Musical Instrument Digital Interface) device, and which displays, as lyrics, the text code identified as lyrics data (see, for example, Japanese Patent No. 3918580 corresponding to U.S. Pat. No. 7,447,986).

The aforementioned conventionally-known performance data creation apparatus, however, is not satisfactory for the following reasons. Namely, when a chord progression is to be designated for each of the sets, a user has to designate, one by one, individual cords constituting the chord progression through selection operations, editing operations, etc., which would therefore impose burdensome operations on the user and require the user to have a certain amount of knowledge of chords.

Further, with the aforementioned conventionally-known multimedia information reproduction apparatus, a chord progression satisfying a musical format cannot be acquired although the text code identified as performance information can be converted into performance event information. Namely, although the conventionally-known technique can identify chord names from text data, it cannot add appropriate beat positions to the identified chord names. Thus, in a case where a chord progression is necessary for generation of performance data, a user has to designate, one by one, individual cords constituting the chord progression through selection operations, editing operations, etc. as in the aforementioned performance data creation apparatus. Namely, the aforementioned conventionally-known multimedia information reproduction apparatus too can present the same problems as the data creation apparatus.

Normally, in a chord chart created in text data, a bar line is indicated by "|" (more specifically, text code of "|", and one or more chord names between "|" and "|" represents a chord progression of that bar (or measure). Essentially, there is an original music piece corresponding to such a chord chart created in text data, and a musical meter or time of the chord chart matches a musical time of the original music piece. However, in some cases, musical time information itself is not included in the chord chart.

In the aforementioned conventionally-known performance data creation apparatus, once a user designates accompaniment style data (and section) and inputs chords (chord progression), accompaniment pattern data of the designated accompaniment style data (and section) is deployed in accordance with the input chords, so that automatic accompaniment data is generated. A musical time is predetermined for each accompaniment style data and automatic accompaniment data is generated on the basis of the predetermined musical time. Thus, if a musical time of accompaniment style data and a musical time of a chord progression do not match each other, automatic accompaniment data presenting an unnatural chord change can be undesirably generated. With the conventionally-known performance data creation apparatus, however, such a problem can be avoided because the musical time of the accompaniment style data and the musical time of the input chord progression are set to match each other. However, if a chord chart created in text data is input and automatic accompaniment data is generated on the basis of a chord progression written in the chord chart, it is sometimes likely that the generated automatic accompaniment data and the chord chart do not match each other in musical time because no musical time information is included in the chord chart.

In generation of, for example, musical score data as well as in generation of automatic accompaniment data, the disagreement in musical time would create an inconvenience that a chord name is displayed at an inappropriate position if a musical time different from that of an input chord progression is set for the musical score data. The same can be said even when arrangement data is generated.

SUMMARY OF THE INVENTION

In view of the foregoing prior art problems, it is an object of the present invention to provide an improved technique which allows even a user with no knowledge of chords to readily generate chord progression information matching a musical time of music data to be generated and generate the music data on the basis of such chord progression information.

In order to accomplish the above-mentioned object, the present invention provides an improved music data generation apparatus comprising a processor, the processor being configured to: acquire a chord chart described in text; acquire musical time information indicative of a musical time of music data to be generated; extract individual chords and bar lines from the acquired chord chart; and generate chord progression information by allocating in-bar (i.e., in-measure) relative time positions to the extracted individual chords in accordance with the musical time indicated by the acquired musical time information and the extracted bar lines.

According to the present invention, chord progression information satisfying a musical format (i.e., format including relative time positions in each measure or bar, or in-bar relative time positions) can be automatically generated on the basis of the chord chart described in text. Namely, because the chord progression information is generated by allocating appropriate in-bar relative time positions (e.g., appropriate beat positions), based on the musical time indicated by the musical time information, to the individual chords constituting the chord chart, it attains general versatility as music performance information, i.e. satisfies a musical format. Such chord progression information satisfying a musical format is applicable to a variety of applications as music data. By applying the chord progression information to automatic accompaniment data, the chord progression information can be readily used as chord designation information for an automatic accompaniment. Further, by displaying a chord chart based on the chord progression information, it is possible to display a musically-suitable chord chart that provides chord name indications associated appropriately with beat positions in the bars (in-bar beat positions). Further, the music data generation apparatus of the invention is constructed to acquire musical time information indicative of a musical time of music data to be generated, and thus, even where no musical time information is included in the chord chart described in text, the music data generation apparatus of the invention can automatically generate appropriate chord progression information matching the musical time of the music data to be generated. Because the chord progression information can be automatically generated on the basis of the chord chart described in text, it is possible to save user's time and labor required for performing chord input operations to supply chord information for generation of automatic accompaniment data, which is very efficient. Besides, even a user having no knowledge of chords can readily generate music data related to a chord progression.

In an embodiment, the in-bar relative time positions to be allocated to the extracted individual chords are beat positions. If music data is generated on the basis of the chord progression information where chords are allocated to such beat positions, a natural music flow can be achieved auditorily and visually (i.e., on a display screen) because the generated music data is automatically adjusted to allow a chord change to occur at a natural position. Thus, the user does not have to care a musical time assumed in an original chord chart from which the chord progression information has been acquired.

In an embodiment, the in-par relative time positions to be allocated to the extracted individual chords are adjusted in accordance with sound generation timing of accompaniment sounds indicated by the accompaniment pattern data. Although a chord change often occurs at a beat position, it may sometimes deviate from a beat position depending on a rhythm of a music piece itself. For example, in the case of "swing", a performance of a more swing feeling can be provided if a chord change is caused to occur at timing slightly delayed behind chord change timing allocated to a beat position or a note. By adjusting the in-bar relative time positions allocated to the individual chords in accordance with sound generation timing of accompaniment sounds, the present invention can generate music data where a chord change is made at timing slightly displaced from a beat position.

In an embodiment, the processor is further configured to extract musical passage information from the acquired chord chart, and the extracted musical passage information is added to the music data to be generated. In a case where musical passage information, such as a musical passage mark (musical passage name), the present invention can extract such musical passage information too and use the extracted musical passage information for generation of music data. In this way, the present invention can generate music data utilizing more efficiently information possessed by the acquired chord information.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
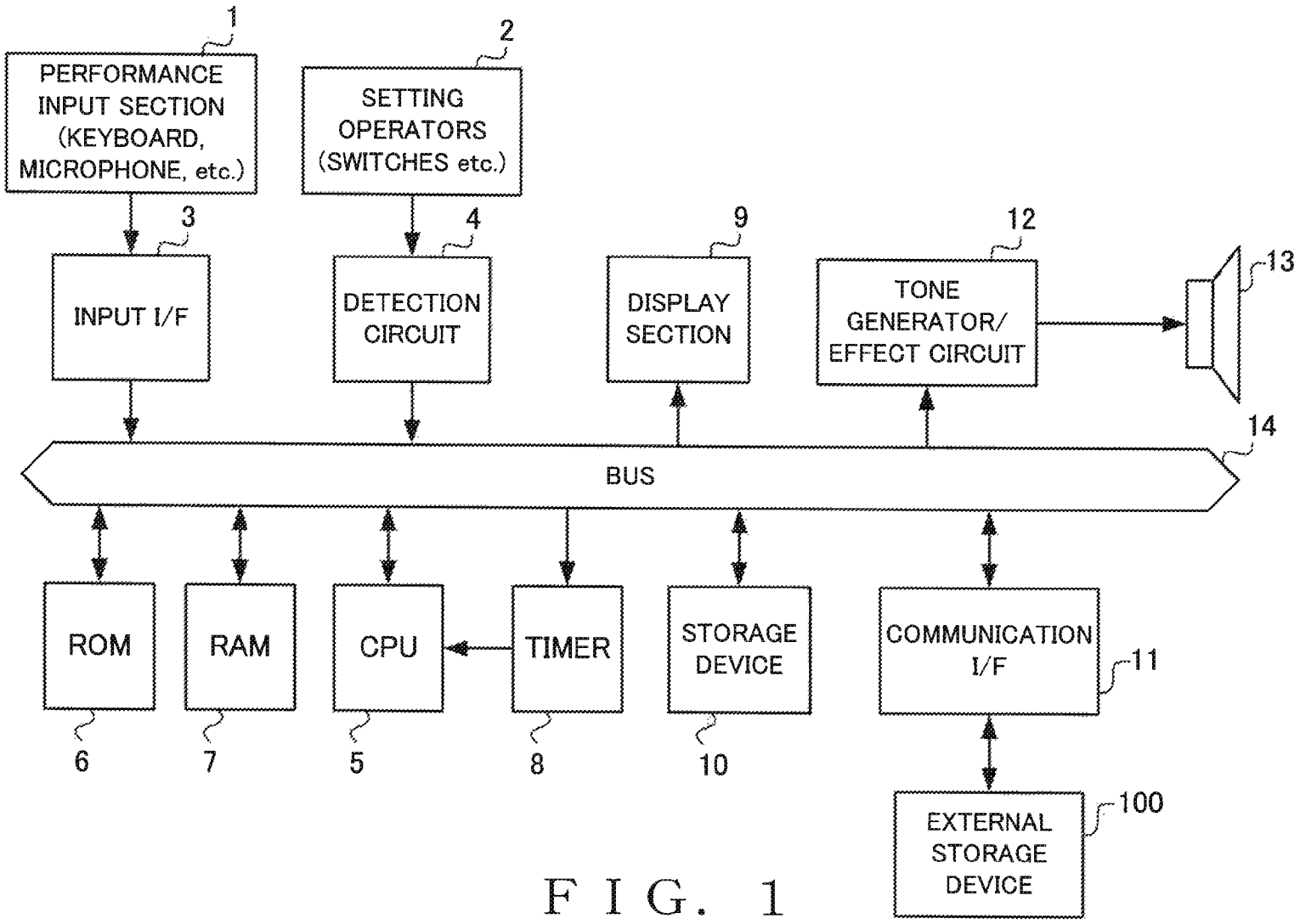
FIG. 1 is a block diagram showing an example overall setup of an embodiment of a music data generation apparatus of the present invention.

FIG. 1 is a block diagram showing an example overall setup of an embodiment of a music data generation apparatus of the present invention. As shown, the embodiment of the music data generation apparatus includes: a performance input section 1 that inputs performance information (including voice information too) corresponding to a user's performance operation; a group of setting operators 2 including switches operable to input various information; an input interface (I/F) 3 that introduces the performance information, input via the performance input section 1, into the music data generation apparatus after converting the input performance information into an electrical signal; a detection circuit 4 that detects operating states of the setting operators 2; a CPU (Central Processing Unit) 5 that controls the entire music data generation apparatus; a ROM (Read-Only Memory) 6 that stores therein control programs for execution by the CPU 5, various table data, etc.; and a RAM (Random Access Memory) 7 that temporarily stores therein performance data, various input information, results of arithmetic operations, etc. The embodiment of the music data generation apparatus of the present invention also includes: a timer 8 that counts interrupt times in timer interrupt processes and various time lengths; a display section 9 including, for example, an LCD (Liquid Crystal Display), an LED (Light Emitting Diode), etc.; a storage device 10 that stores therein various application programs including the above-mentioned control programs, various accompaniment pattern data, chord chart data, various music piece data (various song data), various other data, etc.; a communication interface (I/F) 11 that has an external storage device 100 connected thereto so that chord chart data etc. can be referenced and acquired from the external storage device 100 via the communication I/F 11; a tone generator/effect circuit 12 that converts, into a tone or sound signal, performance data input via the performance operator 1 or performance data generated by a sequencer (not shown), implemented by the CPU 5 implementing a sequencer program, reproducing and outputting automatic performance data and that imparts any of various effects to the tone signal; and a sound system 13 including a DAC (Digital-to-Analog Converter), amplifier, speaker, etc.

The above-mentioned structural components 3 to 12 are interconnected via a bus 14. The timer 8 is connected to the CPU 5, the external storage device 100 is connected to the communication I/F 11, and the sound system 13 is connected to the tone generator/effect circuit 12.

The performance input section 1 include a keyboard that inputs key depression/release information, including pitch information and intensity information, in response to a user's key depression/release operation, a microphone that picks up a voice uttered by the user to convert the picked-up voice into an analog voice signal.

The input I/F 3 converts key depression/release information input, via the keyboard, into performance data, such as MIDI data (event data), and stores the converted event data into an event buffer (not shown) provided for temporarily storing event data. The input I/F 3 also converts an analog voice signal, input via the microphone, into a digital voice signal (voice data) to store the voice data into a voice data buffer (not shown) provided for temporarily storing voice data.

The storage device 10 includes, for example, any of storage media, such as a flexible disk (FD), a hard disk (HD), a CD-ROM, a digital versatile disk (DVD), a magneto-optical disk (MO) and a semiconductor memory, and a drive device for driving the storage media. The storage media may be detachable from the drive device, or the storage device 10 may itself be detachable from the music data generation apparatus. Alternatively, both the storage media and the storage device 10 may be detachable from the music data generation apparatus. Any of the control programs for execution by the CPU 5 can be stored in the storage device 10 (storage media of the storage device 10). Thus, in a case where a particular control program is not prestored in the ROM 6, the control program may be stored in the storage device 10, so that, by reading the control program from the storage device 10 into the RAM 7, the CPU 5 is allowed to operate in exactly the same way as in the case where the particular control program is stored in the ROM 6. This arrangement greatly facilitates version upgrade of the control program, addition of a new control program, etc.

The communication I/F 11 may be, for example, a general-purpose, short-distance wired I/F like USB (Universal Serial Bus) or IEEE1393, a general-purpose network I/F like as Ethernet (registered trademark), or a general-purpose, short-distance wireless I/F like a wireless LAN (Local Area Network) or Bluetooth (registered trademark). As an example, Ethernet is employed as the communication I/F 11, to which is connected the external storage device 100 that is connected, for example, to a server computer on the Internet. As an example, the server computer (more specifically, the external storage device 100 of the server computer) functions as a supply source of chord chart data. In addition, in a case where the various programs and the various parameters are not stored in the storage device 10, the server computer (more specifically, the external storage device 100 of the server computer) may be caused to function as a source of such programs and parameters. In such a case, the music data generation apparatus, which is a client of the server computer, transmits a command requesting a program and parameters to the server computer via the communication I/F 11 and the Internet. In response to receipt of such a request, the server computer delivers the requested program and parameters to the music data generation apparatus via the Internet. Then, the music data generation apparatus receives the program and parameters via the communication I/F 11 and cumulatively stores the received program and parameters into the storage device 10.

Whereas the embodiment of the music data generation apparatus of the present invention is built on an electronic keyboard instrument as seen from the above, the present invention is not so limited, and it may be built on a general-purpose personal computer (PC) having a keyboard externally connected thereto. Further, because the present invention can be implemented without calling for a keyboard as an essential element of the invention, it may be applied to, or built on, a string musical instrument, a wind instrument, or the like. Also, the present invention may be applied to other electronic equipment than electronic musical instruments, such as a general-purpose PC or smart device having no keyboard externally connected thereto.

Control processing performed in the embodiment of the music data generation apparatus constructed in the above-described manner will be first outlined with reference to FIG. 2 and then detailed with reference to FIGS. 3 to 7.

Figure 2:
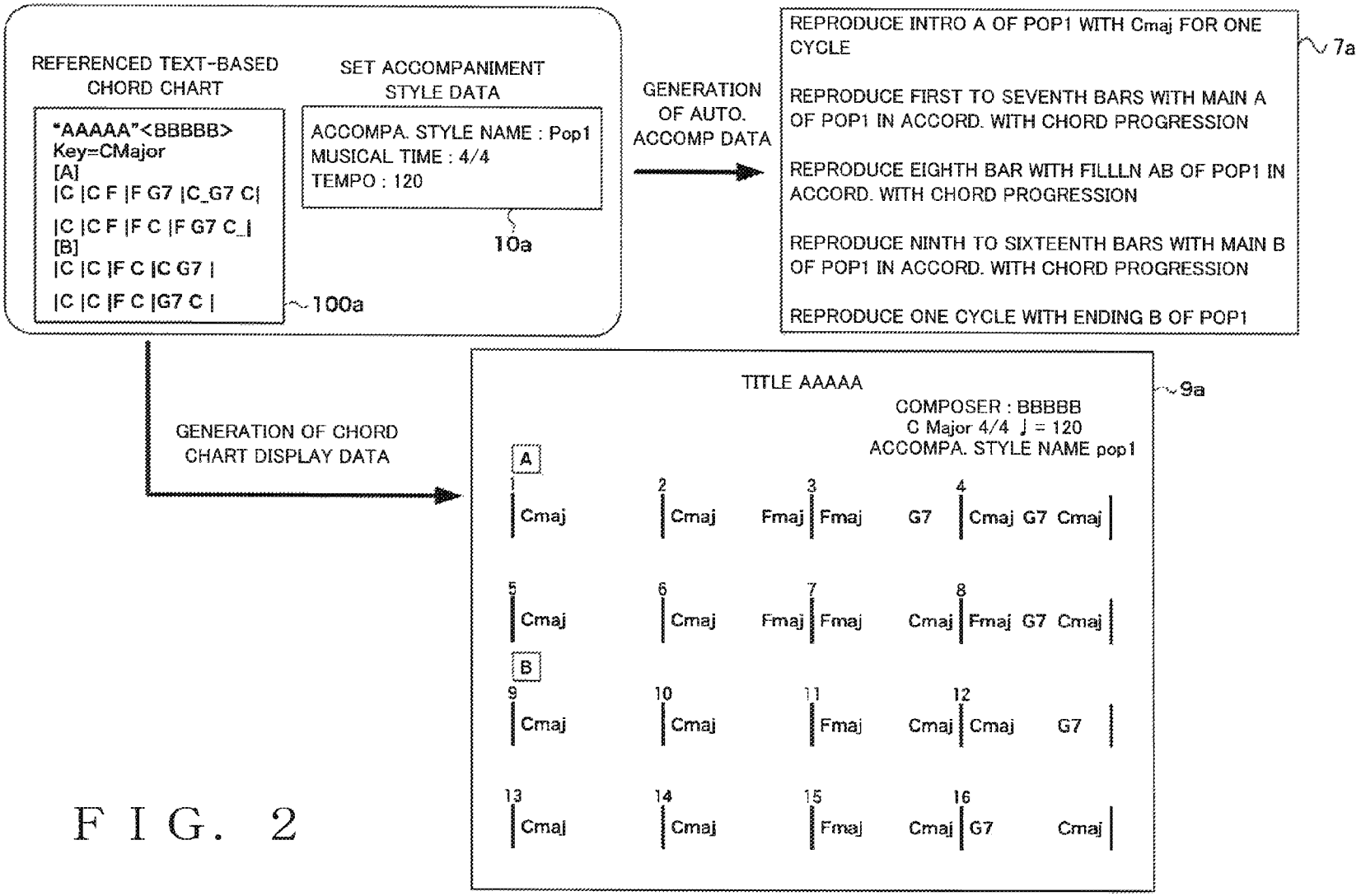
FIG. 2 is a diagram showing an example of music data generated by the embodiment of the music data generation apparatus.

FIG. 2 is a diagram showing an example of music data generated by the embodiment of the music data generation apparatus, where, for example, chord chart display data and automatic accompaniment data are generated as the music data. In the figure are shown a chord chart 9*a* displayed by the generated chord chart display data being displayed on the LCD of the display section 9, and an operational sequence 7*a* in accordance with which the generated automatic accompaniment data is reproduced.

When chord chart display data is to be generated, the embodiment of the music data generation apparatus generates the chord chart display data with primary reference to text-based chord chart data. When automatic accompaniment data is to be generated, on the other hand, the embodiment of the music data generation apparatus generates the automatic accompaniment data with reference to accompaniment style data as well as the text-based chord chart data. The accompaniment style data is not necessarily essential for generation of the chord chart display data. However, because the embodiment of the music data generation apparatus is constructed to generate both chord chart display data and automatic accompaniment data, it is constructed to require accompaniment style data, i.e. require selection and setting of the accompaniment style data. Note, however, that the embodiment is not necessarily limited to such a construction. For example, the embodiment of the music data generation apparatus may be constructed to be switchable between a first operation mode for generating only chord chart display data and a second operation mode for generating only automatic accompaniment data so that it generates only music data allocated to a selected one of the first and second operation modes.

For example, once the user depresses a chord chart display data/automatic accompaniment data generation processing start switch (not shown) included in the aforementioned group of setting operators 2, the chord chart display data/automatic accompaniment data generation processing is started up. First, the CPU 5 inquires of the user which text-based chord chart data is to be referenced, and, in accordance with a user's response (selection) to that inquiry, the CPU 5 acquires, from a particular supply source, the text-based chord chart data (i.e., chord chart described in text) to be referenced. Specific ways to inquire of the user and acquire the chord chart will be described in detail below in relation to control processing.

Let it be assumed here that chord chart data to be referenced (reference source data) is stored in the external storage device 100 connected to the apparatus via the communication I/F 11 and the Internet. Namely, the reference source data is supplied by the server having the external storage device 100 connected thereto. Let it also be assumed that the referenced text-based chord chart (hereinafter referred to also as "reference source chord chart data") 100*a* shown in FIG. 2 is data selected by the user in response to the above inquiry.

Similarly, the CPU 5 inquires of the user about a way to acquire musical time (or meter) information, an accompaniment style name, types of information to be added to chord chart display data to be generated, a way to acquire musical passage information, etc. Let it also be assumed that, in response to such inquiries, the user has selected "acquiring a musical time set in selected accompaniment style data" as the way to acquire musical time (or meter) information, "Pop1" as the accompaniment style name, "bar (measure) No., musical passage name, bibliographic information of the reference source data and accompaniment style name" as the types of information to be added to chord chart display data to be generated and "extraction from the reference source data" as the way to acquire musical passage information.

Once "Pop1" is selected as the accompaniment style name, the CPU 5 searches for a storage location of substantive data, i.e. accompaniment style data, of the selected accompaniment style name "Pop1" and puts the accompaniment style data in a readable state. Assume here that the accompaniment style data of "Pop1" is data stored in the storage device 10. The accompaniment style data of "Pop1" will hereinafter be referred to as "accompaniment style data 10*a*".

Upon completion of such preparatory operations, the CPU 5 sets musical time information. Assuming that "acquiring a musical time set in selected accompaniment style data" is selected as the way to acquire the musical time information to be set as noted above, the CPU 5 reads out musical time information (indicative for example of 4/4) from bibliographic information of the accompaniment style data 10*a* and temporarily stores the read-out musical time information into the RAM 7.

Then, the CPU 5 extracts (identifies), from the reference source chord chart data 100*a*, individual chords (i.e., chord names) and bar lines, allocates relative time positions in bars (in-bar relative time positions) to the extracted individual chords in accordance with a musical time indicated by the acquired (set) musical time information and the extracted bar lines and thereby generates chord progression information. Because a region from one bar line "|" to the next bar line "|" indicates one bar in the reference source chord chart data 100*a*, the CPU 5 reads out character string or text data between the bar lines and identifies the individual chords (chord names) from the read-out character string data. In this manner, the CPU 5 sequentially generates chord information (each comprising sound generation timing, chord root and chord type), bar by bar, on the basis of a series of the identified (extracted) chords (chord names). The musical time information (more specifically, the number of clock ticks per quarter note, i.e. fundamental information about relative time positions). The chord progression information is generated by the CPU 5 performing the bar-by-bar chord information generation through to the last bar.

Next, the CPU 5 sets musical passage information. Because "extraction from the reference source data" has been selected as the way to acquire musical passage information as noted above, the musical passage information to be set is extracted from the reference source chord chart data 100*a*. Then, because "bar No. and musical passage name" have been selected as musical-passage-related information among the "types of information to be added to chord chart display data to be generated" as noted above, the CPU 5 extracts "bar No. and musical passage name" from the reference source chord chart data 100*a*. In the reference source chord chart data 100*a*, the musical passage name is indicated by character string data (by one character like [A] or [B], rather than a character string, in the illustrated example of the reference source chord chart data 100*a*) enclosed by "[" and "]", the CPU 5 reads out the character string data to thereby extract the musical passage name. Also, the CPU 5 extracts (generates) bar Nos. by sequentially counting bars between the bar line marks "|".

Further, because, of the types of information to be added to chord chart display data to be generated, "bibliographic information of the reference source data and accompaniment style name" have also been selected, the CPU 5 extracts "title", "composer" and "musical key" from the reference source chord chart data 100*a* and extracts "accompaniment style name" from the accompaniment style data 10*a* of "Pop1".

The CPU 5 generates and displays chord chart display data on the basis of the chord progression information, musical time information, musical passage information and other additional information generated or extracted in the aforementioned manner, so that a chord chart 9*a* is displayed on the LCD of the display section 9.

Further, the CPU 5 generates and reproduces automatic accompaniment data on the basis of the chord progression information, musical passage information and accompaniment style data 10*a* generated or extracted in the aforementioned manner. In a case where the accompaniment style data 10*a* comprises accompaniment pattern data of a plurality of sections, such as "Intro A", "FillIn AA", "Ending A", "Intro B", "Main B", "FillIn BB", "Ending B", "FillIn AB" and "FillIn BA", "A" and "B" are extracted as the musical passage information from the reference source chord chart data 100*a*. Thus, the CPU 5 can generate automatic accompaniment data by automatically switching between (allocating) sections on the basis of the musical passage information. As one specific example, the "Main A" section is allocated to the musical passage "A", the "Main B" section is allocated the musical passage "B", the "Intro A" section and the "Ending B" section, taking into account variations of the sections, to the beginning and end, respectively, of the automatic accompaniment data to be generated, and any one of the FillIn sections ("FillIn**" where each "*" represents a character indicative of any one of "A" and "B") taking into account variations of the sections is inserted in a bar immediately before section switching. In this way, automatic accompaniment data is generated such that reproduction of the automatic accompaniment data is executed in accordance with the operational sequence 7*a*.

Thus, even where no musical time information is included in the reference source data, the instant embodiment of the music data generation apparatus acquires, from another source, a musical time matching a musical time of music data to be generated and generates not only chord progression information of the acquired musical time but also the music data on the basis of the chord progression information. In this way, the instant embodiment of the music data generation apparatus can readily acquire chord progression information that matches the musical time of the music data to be generated and that is usable in generation of the music data. Further, because the chord progression information is automatically generated on the basis of the reference source data, chord input operations can be simplified to thereby achieve an enhanced efficiency, and even a user having no knowledge of chords can generate music data.

Because even a user having no knowledge of chords can readily acquire suitable chord progression information in the aforementioned manner, the number of occasions when music content data, such as accompaniment style data, serving as a basis for generation of music data is utilized will increase.

Further, in a case where a musical passage mark (musical passage name) is included in the reference source data, the instant embodiment of the music data generation apparatus can extract the musical passage mark as well from the reference source data and utilize the extracted musical passage mark for generation of music data (automatic accompaniment data), and thus, the instant embodiment can generate music data more efficiently utilizing information included in the reference source data. Note that, because no musical passage mark is often included in reference source data, generated music data can be made more satisfying by extracting musical passage information on the basis of generated chord information and referencing the extracted musical passage information at the time of generation of music data.

Next, the control processing performed in the instant embodiment of the music data generation apparatus will be described in more detail.

Figure 3:
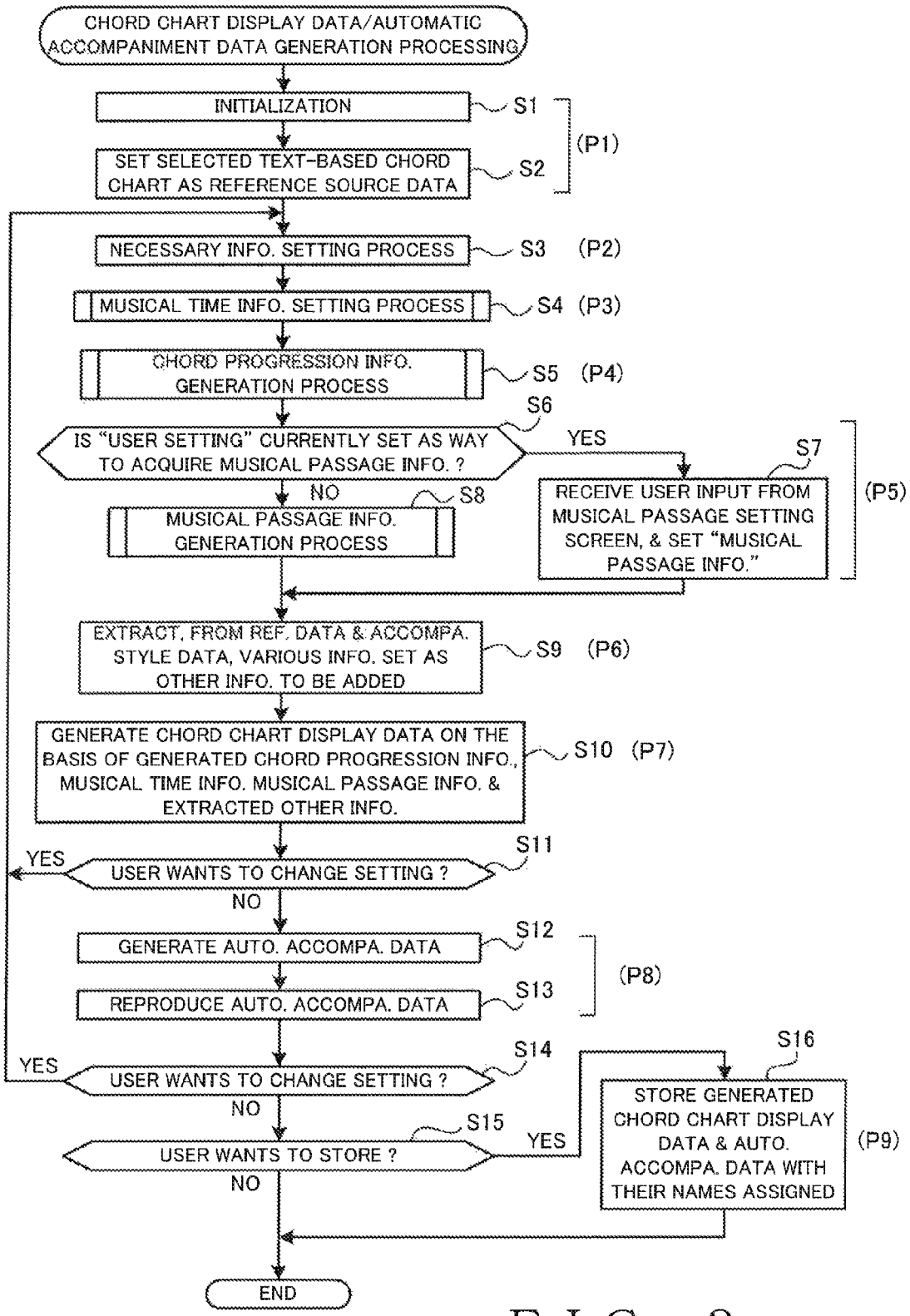
FIG. 3 is a flow chart showing an example operational sequence of chord chart display data/automatic accompaniment data generation processing performed by a CPU in the instant embodiment of the music data generation apparatus.

FIG. 3 is a flow chart showing an example operational sequence of the chord chart display data/automatic accompaniment data generation processing performed by the CPU 5 in the instant embodiment of the music data generation apparatus.

The chord chart display data/automatic accompaniment data generation processing mainly comprises:

(P1) start process (steps S1 and S2);

(P2) necessary information setting process (step S3);

(P3) musical time information setting process (step S4);

(P4) chord progression information generation process (step S5);

(P5) musical passage information setting process (steps S6 to S8);

(P6) other information extraction process (step S9);

(P7) chord chart display data generation/display process (step S10);

(P8) automatic accompaniment data generation/reproduction process (steps S12 and S13); and (P9) storage process (step S16).

The chord chart display data/automatic accompaniment data generation processing is started up in response to a user's start instruction that is given, for example, by the user turning on a predetermined switch included in the group of setting operators 2, or touching a predetermined button displayed on a display screen of the LCD of the display section 9 in a case where the LCD is of a touch panel type. Namely, in the case where the display screen is in the form of a touch panel, the tuning-on operation of the physical switch is replaceable with a touching operation on a button displayed on the display screen by software (hereinafter referred to as "software button"). Thus, let it be assumed that, even where only a turning-on (or turning-off) operation of a physical switch is mentioned in the following description, such a turning-on (or turning-off) operation may be replaced with, or performed together with, a touch operation on a software button.

Upon start of the chord chart display data/automatic accompaniment data generation processing, the CPU 5 performs the start process (P1) once and then sequentially performs the subsequent processes (P2) to (P7). Once the chord chart display data generation/display process (7) is performed, the chord chart 9*a* as shown in FIG. 2 is displayed on the LCD of the display section 9, and thus, the user can judge whether he or she wants to change any of various settings made in the processes (P2) to (P6). If the user wants to change any one of the settings by performing an ON operation of a predetermined switch included in the group of setting operations 2, the CPU 5 reverts to the necessary information setting process (P2) (step S11→step S3) and repeats the processes (P2) to (P7). If, on the other hand, the user does not wish to change any one of the settings, the CPU 5 proceeds to the automatic accompaniment data generation/reproduction process (P8). Once the automatic accompaniment data generation/reproduction process (P8) is performed, the generated automatic accompaniment data is reproduced in accordance with the operational sequence 7*a* as shown in FIG. 2, and thus, by listening to the reproduced sounds, the user can judge whether it wants to change any of the various settings made in the processes (P2) to (P6). If the user wants to change any one of the settings, the CPU 5 reverts to the necessary information setting process (P2) (step S14→step S3) and repeats the processes (P2) to (P7). If, on the other hand, the user does not wish to change any one of the settings, the CPU 5 inquires, at step S15, the user of whether he or she wants to store the generated chord chart display data and/or automatic accompaniment data. If the user wants to store the generated chord chart display data and/or automatic accompaniment data as determined at step S15, the CPU 5 proceeds to the process (P9) (step S15→step S16). If, on the other hand, the user does not want to store the generated chord chart display data and/or automatic accompaniment data as determined at step S15, the CPU 5 terminates the instant chord chart display data/automatic accompaniment data generation processing (step S15→end).

In the start process (P1), the CPU 5 first performs an initialization operation at step S1. In the initialization operation, the CPU 5 secures and initializes the following regions:

necessary information setting region that is provided for storing necessary information set by the necessary information process (P2);

musical time information storage region that is provided for storing musical time information set by the musical time setting process (P3);

musical passage storage region that is provided for storing musical passage information set by the musical passage information setting process (P5);

chord chart display data storage region that is provided for storing chord chart display data generated by the chord chart data generation/display process (P7); and automatic accompaniment data storage region that is provided for storing automatic accompaniment data generated by the automatic accompaniment data generation/reproduction process (P8).

Next, in response, for example, to a user's instruction, the CPU 5 accesses a predetermined server, i.e. a server having the external storage device 100 connected thereto, via the communication I/F 11, acquires from the server list information of (names) of various text-based chord chart data stored in the external storage device 100, and displays the acquired list information on the LCD of the display section 9. Once the user selects any one of text-based chord chart data, the CPU 5 sets the selected chord chart data as the reference source data at step S2. However, the way to acquire reference source data in the instant embodiment is not so limited; for example, there may be employed an alternative way in which a search screen is displayed on the LCD of the display section 9 and in which, once the user inputs a music piece name, composer's name and other search keyword(s) and then instructs a search, the CPU 5 transmits the input search keywords to the server and then displays a list of results of the search transmitted from the server in response to the transmitted search keywords. The operation of step S2 performed by the CPU 5 corresponds to acquiring a chord chart described in text.

Because the selection of the reference source data is permitted only at step S2 and, besides, step S2 is included in the start process that is started only once in response to the startup of the chord chart display data/automatic accompaniment data generation processing, the once-selected reference source data cannot be changed during execution of the chord chart display data/automatic accompaniment data generation processing. Namely, to change the once-selected reference source data, it is necessary to terminate the chord chart display data/automatic accompaniment data generation processing and then restart the chord chart display data/automatic accompaniment data generation processing. The reason for employing such arrangements is to just simplify the explanation, and thus, a process for permitting the reference source data to be changed as desired may be added to other than the start process.

In the necessary information setting process (P2), the CPU 5 sets necessary information selected by the user by writing the necessary information into the necessary information storage region. Types of main necessary information are:

(A1) way to acquire musical time information: musical time information is referenced (acquired) in the musical time information setting process (P3) and the way to acquire such musical time information is selected from among an option of acquiring a musical time set by the user (user setting), an option of acquiring a musical time set in selected accompaniment style data and an option of extracting a musical time from the reference source data;

(A2) accompaniment style name: this is information (name) for identifying accompaniment style data that serves as a basis in the automatic accompaniment data generation/reproduction process, and that is selected from among various accompaniment style data stored in the ROM 6 or the storage device 10 (or external storage device 100);

(A3) type of information to be added to chord chart display data to be generated: this is indicative of a type of information to be displayed in addition to a chord progression display, and this type of information is selected from among a bar No., musical passage name, accompaniment style name, etc; and (A4) way to acquire musical passage information: musical passage information is referenced (acquired) in the musical passage information setting process (P5), and the way to acquire musical passage information is selected from among options of user setting, extraction from the reference source data, etc.

For example, as the way to set the information set forth in items (A1) to (A4) above, a plurality of options may be displayed for each of the information, and options selected by the user from among the displayed options may be set as the item (A1) to item (A4) information; however, the present invention is not so limited.

Figure 4:
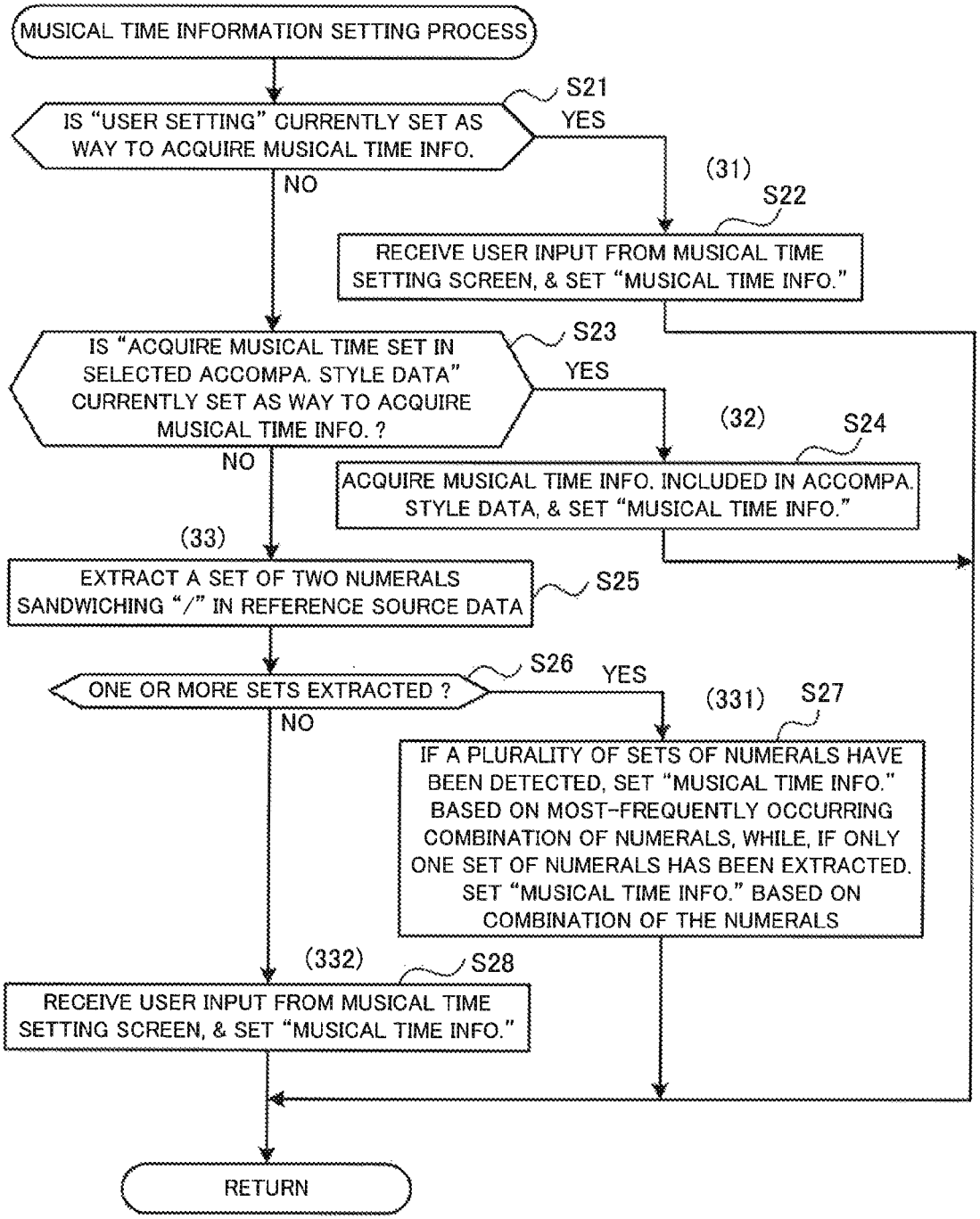
FIG. 4 is a flow chart showing an example detailed operational sequence of a musical time information setting process shown in FIG. 3.

The musical time information setting process (P3) is a process for setting musical time information for use in the chord progression information setting process (P4), and FIG. 4 is a flow chart showing an example detailed operational sequence of the musical time information setting process.

In the musical time information setting process, the CPU 5 takes different routes of operations depending on the selected way to acquire musical time information (A1), as will be described below.

Namely, (31) if "user setting" is currently set as the way to acquire musical time information, the CPU 5 displays a musical time setting screen (not shown) on the LCD of the display section, and, once a user input is made on the displayed musical time setting screen, the CPU receives this user input and writes musical time information designated by the user input into the musical time information storage region to thereby set the "musical time information" (step S21→step S22).

(32) If "acquiring a musical time set in selected accompaniment style data" is currently set as the way to acquire the musical time information, the CPU 5 acquires musical time information included in the accompaniment style data indicated by the "accompaniment style data" (A2) written in the necessary information storage region (as indicated by the accompaniment style data 10*a* of FIG. 2, the accompaniment style data normally includes musical time information) and writes the acquired musical time information into the musical time information storage region to thereby set "the musical time information" (step S23→step S24).

(33) If "extracting a musical time from the reference source data" is currently set, two numerals sandwiching "/" in the reference source data is extracted (step S23→step S25).

(331) If a plurality of sets of numerals sandwiching "/" in the reference source data have been extracted, musical time information is determined on the basis of a combination of the numerals which occurs mostly frequently. If only one set of numerals sandwiching "/" in the reference source data has been extracted, musical time information is determined on the basis of a combination of the numerals, and the CPU 5 writes the thus-determined musical time information into the musical time information storage region to thereby set the "musical time information" (step S26→step S27).

(332) If no set of numerals sandwiching "/" in the reference source data has been extracted, the CPU 5 sets "musical time information" through an operation similar to the operation in item (31) above (step S26→step S28).

When the musical time setting screen is to be displayed in the operations in (31) and (332) above, and if there is any musical time information generated then, the musical time information is reflected on the musical time setting screen. The operation in item (332) above is not limited to the aforementioned, and an operation similar to that in item (32) may be performed, in which case musical time information extracted from music piece data may be set if there is corresponding music piece data, or default musical time information may be set.

The above-described musical time information setting process performed at step S4 by the CPU 5 (details of which is shown in FIG. 4) corresponds to acquiring musical time information indicative of a musical time of music data to be generated. Whereas the musical time information setting process has been described above as setting (acquiring) one musical time information, it may set (acquire) a plurality of musical time information in a case where one musical time changes to another during the course of a music piece. Further, selecting desired accompaniment style data (including accompaniment pattern data) at step S3 of FIG. 3 as an example of acquisition of musical time information corresponds to acquiring accompaniment pattern data corresponding to the acquired chord chart.

Referring back to FIG. 3, the chord progression information setting process (P4) is arranged to generate chord progression information from the reference source data. In the chord progression information generation process, musical time information stored in the musical time information storage region, i.e. musical time information set by the musical time information setting process (P3), is used. However, it is assumed here, for simplicity of description, that only one musical time information set by the musical time information setting process (P3) is used, and that the one musical time information does not change during the course of the chord progression information generation process. Note that the chord progression information generation process will be described in detail with reference to the reference source chord chart data 100*a* shown in FIG. 2.

Figure 5:
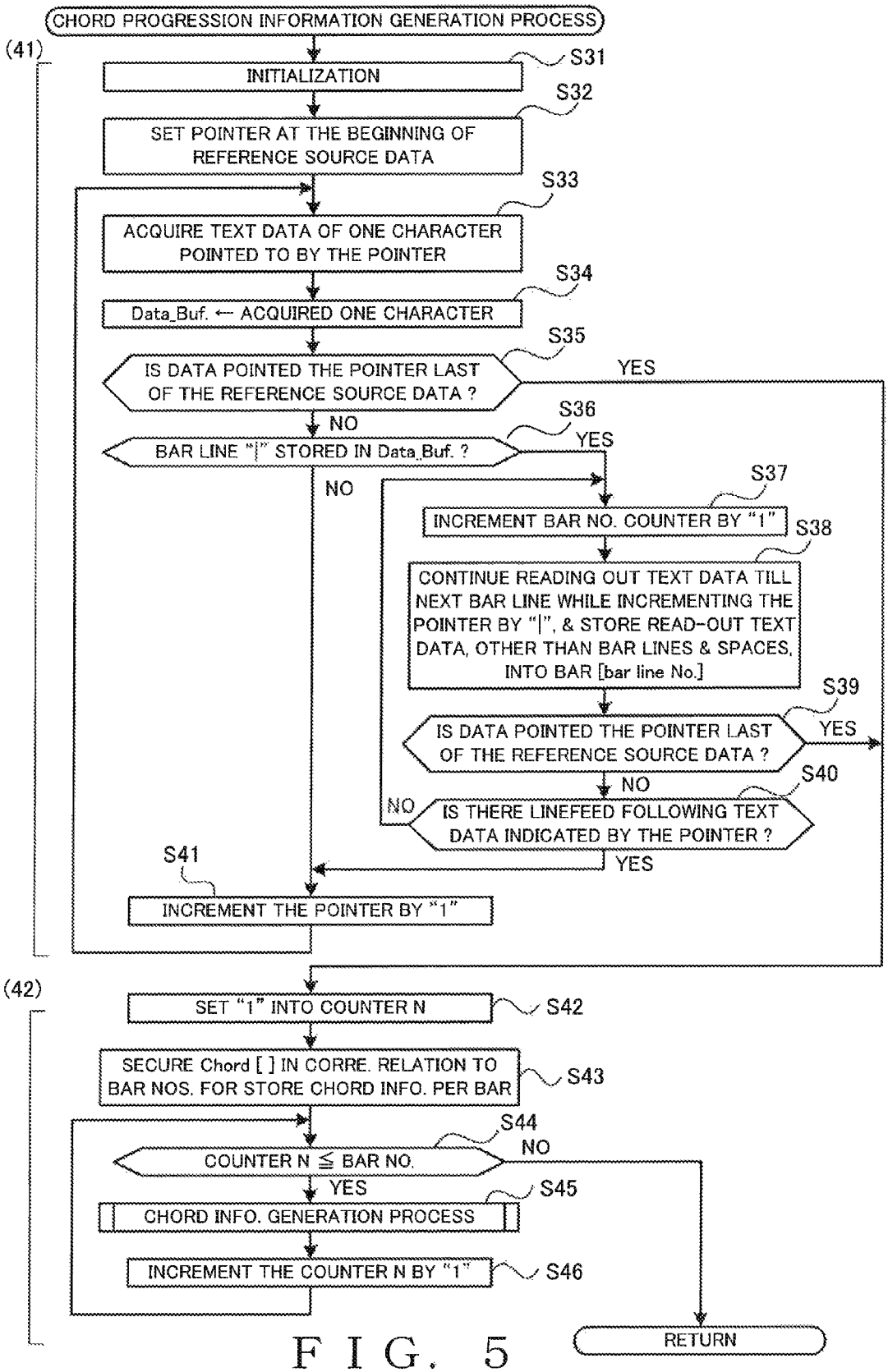
FIG. 5 is a flow chart showing a detailed operational sequence of a chord progression information generation process shown in FIG. 3.

FIG. 5 is a flow chart showing a detailed operational sequence of the chord progression information generation process, which generally comprises:

(41) an in-bar text string acquisition process for reading out, from the reference source data, a text data string included in each bar and the read-out text data string into a region (data array) Bar[ ] (steps S31 to S41); and (42) a chord progression information acquisition process for generating chord information per bar on the basis of the text data string stored in the region Bar[ ] and storing the thus-generated chord information into a region (data array) Chord[ ] (steps S42 to S46).

In the in-bar text string acquisition process (41), the CPU 5 first performs an initialization operation at step S31, where the CPU 5 secures and initializes the following regions in the RAM 7:

a pointer (region) that is a region provided for indicating a position of each text data (specifically, character code data typically in ASCII format) in the reference source data;

a Data_Buf. (region) that is a region for temporarily storing text data of one character in the reference source data indicated by the pointer;

a Bar[ ] (data array) that is a region (data array) for storing a text data string included in each bar in the reference source data; and a bar No. counter that is a software counter (count region) for counting bars in order to indicate a bar No.; a number indicated by the count is referred to as "bar No.".

Next, the CPU 5 sets the pointer (pointer value) to indicate the beginning of the reference source data at step S32. Then, the CPU 5 acquires text data of one character at the position indicated by the pointer at step S33 and stores the acquired text data of one character into the Data_Buf. region at step S34.

Then, the CPU 5 continues reading out text data from the reference source data while advancing the pointer by "1" at a time until text data indicative of a bar line "|" is stored into the Data_Buf. region (step S36→step S41→step S33→step S34→step S35→step S36).

Once the text data indicative of the bar line "|" is read out from the reference source data, the CPU 5 increments the bar No. counter by "1" at step S37 and then continues reading out the text data till the next bar line "|" while advancing the pointer by "1" at a time. Thus, the CPU 5 stores the read-out text data, other than those indicative of the bar line "|" and spaces, into the Bar[bar line No.] at step S38. Then, the CPU 5 repeats the operations of steps S37 and S38 until text data indicative of a linefeed appears following text data located at the position pointed to or indicated by the pointer, i.e. until the pointer indicates a position immediately preceding the "linefeed" indicative of the end of a line (step S40→step S37→step S38→step S39→step S40). Once the text data indicative of the linefeed appears following the text data located at the position indicated by the pointer, the CPU 5 proceeds from step S40 to step S41.

Through the operations performed from first entry into step S37 to first exit from step S40 after startup of the chord progression information generation process, text data (except for those indicative of "|" and "space") in a fourth line of the reference source chord data 100*a* of FIG. 2, i.e. "C", "CF", "FG7" and "C_G7C" are stored into Bar[1], Bar[2], Bar[3] and Bar[4], respectively. Note that each "_" included in the text data is a blank mark (chord position adjusting mark) that specifically identifies a beat position where a preceding chord lasts, i.e. where the same chord as at the preceding beat continues. For example, "C_G7C" indicates that chord name "C" is specified for first and second beats, chord name "G7" is specified for a third beat and chord name "C" is specified for a fourth beat. Although inclusion of the blank mark "_" in the text-based chord chart is advantageous, such a blank mark "_" need not necessarily be included in the text-based chord chart. Note that the blank mark may be any other desired mark than "_"; for example, a group of a plurality of successive space marks may be regarded as one blank mark corresponding to one beat.

Once the position indicated by the pointer reaches the end of the reference source data during repetition of the operations of steps S33 to S41, the CPU 5 jumps to the chord progression information process (42) (step S35 or S39→step S42). As a result, text data in fifth, seventh and eighth lines too are stored into Bar[5] to Bar [16].

In the chord progression information acquisition process (42), the CPU 5 first secures a software counter region N (hereinafter referred to simply as "counter N") in the RAM 7 and sets a value "1" into the counter N, at step S42. The counter N too counts bar Nos. similarly to the above-mentioned bar No. counter, but it counts from "1" only up to the current count value of the bar No. counter.

Next, at step S43, the CPU 5 secures, in the RAM 7, regions (data arrays) Chord[ ] corresponding in number to the "bar Nos." for storing therein chord information per bar. Each of the regions (data arrays) Chord[ ] comprises an area (data array) ChdTime for storing time information (sound generation timing) of the chord information, an area (data array) ChdRoot for storing a root of the chord information, and an area (data array) ChdType for storing a type of the chord information.

Then, the CPU 5 repeats a chord information generation process (step S45) and incrementing of the counter N until the count value of the counter N becomes greater than the "bar No." (step S46) (step S44→step S45→S46→S44).

Figure 6:
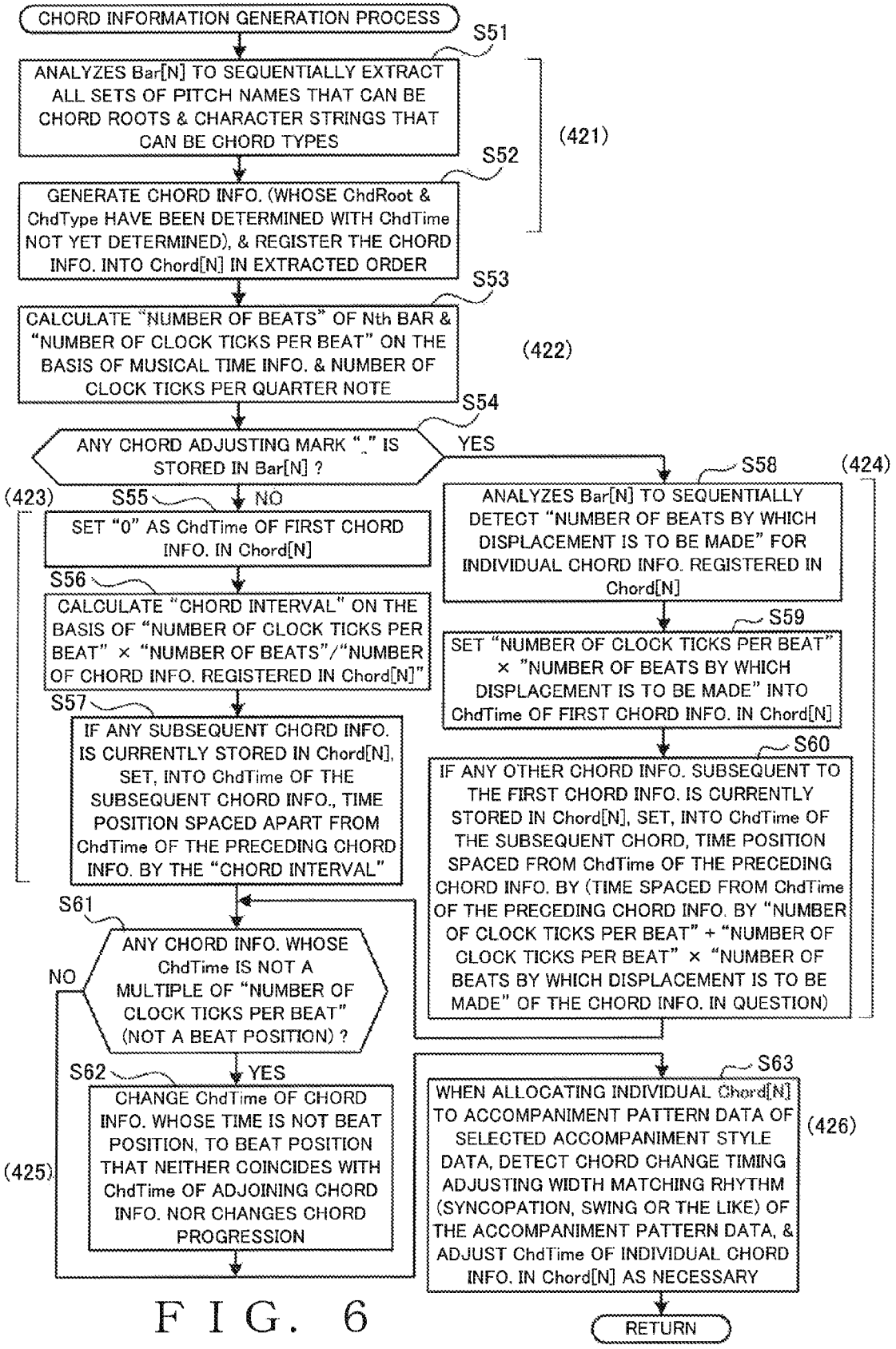
FIG. 6 is a flow chart showing a detailed operational sequence of a chord information generation process shown in FIG. 5.

FIG. 6 is a flow chart showing a detailed operational sequence of the chord information generation process, which mainly comprises:

(421) a registration process for registering the chord root ChdRoot and type ChdType into the region Chord[N] (steps S51 and S52);

(422) a calculation operation for calculating the "number of beats" and "number of clock ticks per beat" in an Nth bar (i.e., bar indicated by the count value of the counter N) (step S53);

(423) a registration process for registering the time ChdTime into the region Chord[N] when no chord position adjusting mark (blank mark) "_" is included in the bar Bar[N] (steps S55 to S57);

(424) a registration process for registering the time ChdTime into the region Chord[N] when the chord position adjusting mark (blank mark) "_" is included in the bar Bar[N] (steps S58 to S60);

(425) a change operation for, when the time ChdTime does not match a beat position, changing the time ChdTime to match the beat position (step S62); and (426) an as-necessary adjustment operation for adjusting the time ChdTime as necessary (step S63).

In the registration process (421), the CPU 5 analyzes the region Bar[N] to sequentially extract all sets of pitch names that can be chord roots and character strings that can be chord types, at step S51. A criterion used here for determining a pitch name to be a possible chord root is, for example, that the pitch name is an uppercase (capital) alphabetical letter, and a criterion used here for determining a character string to be a possible chord type is, for example, that the character string is a combination of a lowercase alphabetical letter and an Arabic numeral. Needless to say, the present invention is not so limited. As specific examples of the former criterion (chord root determination criterion), any one of uppercase "A" to "G" may be determined to be a possible chord root, and a character string of two characters starting with any one of uppercase "A" to "G" and ending with "♭" (flat) or "♯" (sharp) may be determined to be a possible chord root. Further, as a specific example of the latter criterion (chord type criterion), a character immediately following the chord root is set as a start point, characters are sequentially checked from the start point, and a character string section lasting till one character before a first-appearing space, chord position adjusting mark, next chord root or other musical passage mark is determined to be a chord type.

If the current count value of the counter N is "2" (N=2), "C" and "F" are extracted sequentially as pitch names that can be chord roots because "CF" is currently stored in the region Bar[2] as noted above. A chord type can be extracted (identified) by detecting characters (or a character string) that can be a chord type other than a major chord type (maj). In other words, if no character than can be a chord type (minor or seventh) other than the major chord type is added to the character (pitch name) that can be a chord root, the chord type is extracted (identified) as the major chord type. If, on the other hand, a character than can be a chord type (minor or seventh) other than the major chord type is added to the character (pitch name) that can be a chord root, then a chord type based on the character (or a character string) is extracted (identified). In the case of the region Bar[2], no character indicative of a chord type is added to any one of the root pitch names "C" and "F", chord types of the chords of the root pitch names "C" and "F" are extracted (identified) as the major chord type. As another example, if the current count value of the counter N is "4" (N=4), "C_G7C" is currently stored in the region Bar[4] as noted above, and thus, "C", "G" and "C" are extracted sequentially as pitch names that can be chord roots, and major, seventh and major are extracted as their respective chord types.

Next, at step S52, the CPU 5 generates chord information (whose chord root ChdRoot and chord type ChdType have been determined with the time ChdTime not yet determined) and registers the thus-generated chord information into the region Chord[N] sequentially in the extracted order. In the case where the counter N="2", two pieces of chord information (-, C, maj) and (-, F, maj) are generated and registered into the region Chord[2]; note that ChdTime (not yet determined and represented by "-"), ChdRoot and ChdType are indicated in the parentheses. Similarly, in the case where the counter N="4", three pieces of chord information (-, C, maj), (-, G, 7) and (-, C, maj) are generated and registered into the region Chord[4].

In the calculation operation (422), the CPU 5 calculates, at step S53, the "number of beats" of the Nth bar and the "number of clock ticks per beat" on the basis of the musical time information and the number of clock ticks per quarter note. Here, let it be assumed that the "musical time information" is the one set by the above-described musical time information setting process (P3), and that the "number of clock ticks per quarter note" has been determined in advance (e.g., at "480"). Further, the "Nth bar" means a particular bar indicated by the current count value of the counter N. If "4/4" time is currently set, "4" is calculated as the number of beats and "480" is calculated as the "number of clock ticks per beat" by the calculation operation (422).

Then, at step S54, the CPU 5 determines whether any chord position adjusting mark "_" (blank mark) is stored in the region Bar[N]. If no chord position adjusting mark "_" (blank mark) is included in the region Bar[N] as determined at step S54, the CPU 5 proceeds to the registration process (423), while, if a chord position adjusting mark "_" (blank mark) is included in the region Bar[N], the CPU 5 moves to the registration process (424). In these registration process (423) and registration process (424), the CPU 5 performs a primary process for placing one or a plurality of chords, included in the bar, at an interval(s) corresponding to the number of the chords in the bar.

In the registration process (423), the CPU 5 first sets "0" as the time ChdTime of the leading or first chord information in the region Chord[N] at step S55.

Then, at step S56, the CPU 5 calculates a "chord interval" by calculating the following mathematical expression:

"chord interval"=("number of clock ticks per beat"*"number of beats")/("number of chord information registered in the region Chord[*N*]")

Then, if any other chord information subsequent to the first chord information is currently stored in the region Chord[N], the CPU 5 proceeds to step S57, where it sets, into the time area ChdTime of the subsequent chord information, a time position spaced apart from the time ChdTime of the preceding chord information by the "chord interval". More specifically, in the case where the counter N="2", "0" is set into the time area ChdTime ("_") of the first chord information (-, C, maj), and a time position (="960") spaced apart from the time ChdTime of the first chord information by the "chord interval" is set into the time area ChdTime area ("_") of the next or second chord information (-, F, maj); thus, (0, C, maj) is registered into the region Chord[2] as the first chord information, and (960, F, maj) is registered into the region Chord[2] as the next chord information. Thus, in the case where no chord position adjusting mark "_" (blank mark) is included, all chords (chord names) present in one bar are positioned at equal intervals in the primary process. Further, if the time position of any one of the chords (chord names) positioned at equal intervals in the aforementioned manner does not match a beat position, then the position of the chord is adjusted to match the beat position, as a secondary process.

In the registration process (424), on the other hand, the CPU 5 first analyzes the region Bar[N] to sequentially detect the "number of beats by which displacement is to be made" for individual chord information registered in the region Chord[N], at step S58. More specifically, the CPU 5 detects the "number of beats by which displacement is to be made" by detecting the number of blank marks "_" appearing in succession till text data representing the root pitch name of the chord information in question. Let it be assumed here that one blank mark "_" corresponds to one beat.

Next, at step S59, the CPU 5 sets a product of "number of clock ticks per beat" *"number of beats by which displacement is to be made" into the time area ChdTime area of the leading or first chord information in the region Chord[N].

Then, if any other chord information subsequent to the first chord information is currently stored in the region Chord[N], the CPU 5 proceeds to step S60, where it sets, into the area ChdTime of the subsequent chord information, a time position spaced apart from the time ChdTime of the preceding chord information by a total amount equal to (time spaced apart from the time ChdTime of the preceding chord information by "the number of clock ticks per beat'+"the number of clock ticks per beat"*"the number of beats by which displacement is to be made" of the chord information in question). More specifically, in the case where the counter N="4", "C_G7C" is currently stored in the region Bar[4], i.e. "_" is located immediately before the second chord information, and thus, one beat is detected at step S58 as the "number of beats by which displacement is to be made" for the second chord information registered in the region Chord[4]. Thus, in this case, "0" is set into the area ChdTime of the first chord information (-, C, maj), and a chord time spaced apart from the chord time of the first (i.e., preceding) chord information (=0) by a total amount equal to "(time spaced apart by 'the number of clock ticks per beat') (=480)+(time position corresponding to 'the number of clock ticks per beat'*'the number of beats by which displacement is to be made' (=1) (=480) (total time=960) is set into the area ChdTime ("-") of the second chord information (-, G, 7), and a time position spaced apart from the time ChdTime (=960) of the preceding chord information (-, G, 7) by the number of beats by which displacement is to be made (i.e., total time=1,440) is set into the area ChdTime ("-") of the last chord information (-, C, maj). Thus, into the region Chord[4], (0, C, maj) is registered as the first chord information, (960, G, 7) is registered as the next chord information, and (1440, C, maj) is registered as the last chord information. Namely, in the case where the chord position adjusting mark "_" (blank mark) is included, positional intervals (i.e., chord change timing) among chords (chord names) present in a bar is adjusted by allocating a position corresponding to one beat to each chord position adjusting mark "_" (blank mark). Thus, the interval between two adjoining chords sandwiching the blank mark can be enlarged. Needless to say, in this case too, a position (time position) of any chord (chord name) can be adjusted as appropriate by the following secondary process.

The secondary process is arranged as follows. Of the one or more chords positioned at an interval corresponding to the number of the chords by the primary process, any chord that does not match a beat position is corrected to be associated with a beat position.

The CPU 5 determines, at step S61, whether any chord information whose time ChdTime is not a multiple of the 'number of clock ticks per beat' (i.e., which is not a beat position) is included in the chord information in the region Chord[N]. If such chord information is included in the chord information in the region Chord[N] (YES determination at step S61), the CPU 5 proceeds to step S62. Otherwise, the CPU 5 branches to the as-necessary adjustment operation (426) of step S63.

In the change operation (425), the CPU 5 changes the time ChdTime of the chord information, which is not a beat position, to a beat position that neither coincides with times ChdTime of adjoining chord information nor changes a chord progression. Let it be assumed here that "4/4" is currently set as the "musical time information" and "480" is currently set as the "number of clock ticks per beat", and that three pieces of chord information, (0, D, min), (640, G, 7) and (1280, C, maj), are currently registered. Because the times "640" and "1280" are each not a beat position, they are changed to "480" (second beat) and "960" (third beat), respectively. In this case, however, there is employed a rule that the earlier of two beat positions adjoining the chord information to be changed should be selected. If another rule that the nearest beat position should be selected is employed, the times "640" and "1280" are changed to "960" and "1440", respectively.

If music data is generated on the basis of chord progression information with sound generation timing of chord information changed to a beat position, the generated music data has been adjusted so that a chord change occurs at a natural position, and thus, a natural music flow can be achieved auditorily and visually (i.e., on a display screen). Thus, the user does not have to care a musical time assumed in an original chord chart from which the chord progression information has been acquired.

The instant secondary process has been described above in relation to the case where the change operation (425) is always performed when the chord information in the region Chor[N] include any chord information whose time ChdTime is not a beat position. Alternatively, an item for allowing the user to select "whether or not to adjust chord timing to match a beat position" may be provided among various items of the necessary information set, for example, by the necessary information setting process (P2), and the change operation (425) may be performed only when the user has selected "adjusting chord timing to match a beat position". As another alternative, an item may be provided for allowing the user to select adjusting the chord timing to match "timing of a predetermined rhythm, such as two-beat, four-beat, eight-beat, sixteen-beat or other beat rhythm. If "adjusting chord timing to match a beat position" is currently selected, beat positions at which individual codes are to be positioned may be adjusted to match beats of a selected beat rhythm.

In the as-necessary adjustment operation (426), when allocating individual chords Chord[N] to accompaniment pattern data (i.e., data indicative of accompaniment sound generation patterns of individual performance parts) included in a currently selected accompaniment style, the CPU 5 detects a chord change timing adjustment width matching a rhythm (syncopation, swing or the like) possessed by the accompaniment pattern data (accompaniment style data), and then it adjusts the times (relative time positions) of individual chord information in the individual regions Chord[N] as necessary. For example, in a case where the accompaniment pattern data syncopates in eighth notes, the time position of chord information allocated to a first beat is advanced by an eight note length (e.g., the value of the time ChdTime matching a beat position is decreased by an amount corresponding to the note length by which the time position is to be advanced). As another example, the time position of the chord information allocated to the first beat may be delayed by an eight note length (e.g., the value of the time ChdTime matching the beat position is increased by the amount corresponding to the note length by which the time position is to be delayed). Note that the chord change timing adjustment width may be detected by providing table data defining an adjustment width per accompaniment style data or per genre and searching through the table data, or by analyzing the accompaniment pattern data (accompaniment style data). Furthermore, this as-necessary adjustment operation (426) may be dispensed with or omitted. This is because the frame of the block of step S63 is depicted in broken line. The user may set as desired whether or not to omit the as-necessary adjustment operation.

Although a chord change often occurs at a beat position, it may sometimes deviate from a beat position depending on a rhythm of a music piece itself (including selected accompaniment style data). For example, in the case of "swing", a performance of a more swing feeling can be provided if a chord change is made at timing slightly delayed behind chord change timing allocated to a beat position or a note. The "slight delay" may be set, for example, in association with the accompaniment style data, in accordance with a parameter, such as a swing ratio, or may be calculated, for example, on the basis of a deviation of the sound generation timing from the beat position by analyzing note event data in the accompaniment pattern data. Depending on the type of the selected accompaniment style data, performance data more closely matching a rhythm feeling of the accompaniment pattern data may sometimes be obtained by displacing the chord change timing from a beat position or a note-based quantizing position.

Further, even in the case of a music piece that syncopates in eight notes, it is conventional to display a chord chart of the music piece so that a chord name is located at the beginning of a bar or a head of a second or subsequent beat rather than an eighth note before a bar line, but, at the time of reproduction, it is more natural to effect a chord change at timing an eighth note earlier than timing indicated on the chord chart, rather than at the indicated timing. In such a case, it is preferable that generation of chord progression information based on a text-based chord chart be performed on a beat-by-beat basis, so that each chord is displayed in association with a beat position on the chord chart displayed on the basis of the chord progression information generated on the beat-by-beat basis, whereas chord change timing based on the generated chord progression information is adjusted in real time when automatic accompaniment pattern data is performed by reproduction by use of the chord progression information generated on the beat-by-beat basis. For the real-time adjustment of the chord change timing, a determination may be made, by analyzing sound generation timing of note event data of the accompaniment pattern data of the accompaniment style data, as to in which type of note the syncopation is, and, when the automatic accompaniment pattern data is performed by reproduction by use of the generated chord progression information, the timing information ChdTime (relative time position) of each chord included in the chord progression information may be adjusted so as to match the determined syncopation. Alternatively, a rhythm possessed by performance data (e.g., data indicative of a manual performance data by the user) of another performance part to be used together with the automatic accompaniment data in the reproductive performance may be analyzed so that the chord change timing is adjusted to match the analyzed rhythm.

Further, whereas the chord information generation process has been described above as generating chord progression information on the bar-by-bar basis and generating chord progression information of a music piece by combining the bar-by-bar chord progression information and bar Nos., the present invention is not so limited, and chord progression information of a music piece may be generated by including bar information (indicative of absolute time positions of an entire music piece having a plurality of bars) as well in the time information (sound generation timing) of individual chord information.

Note that the time information ChdTime of each chord is indicative of a relative time position, in a bar, of the chord (in-bar relative time position of the chord). Therefore, identifying the time information ChdTime of a given chord means, or corresponds to, allocating an in-bar relative time position to the given chord. Further, as known in the art, the chord name of each chord is indicated by a combination of root information ChdRoot and type information ChdType. Therefore, identifying (detecting) the root information ChdRoot and type information ChdType of a given chord means, or corresponds to, extracting the chord (chord name).

The foregoing can be summarized as follows. The operations of steps S31 to S41, S51, S52, etc. performed by the CPU 5 correspond to extracting individual chords and bar lines, and the operations of steps S53 to S63, etc. correspond to generating chord progression information by allocating in-bar relative time positions to the individual extracted chords.

Further, the operations of step S63 etc. performed by the CPU 5 correspond to the in-bar relative time positions to the individual extracted chords being adjusted by sound generation timing of accompaniment sounds indicated by the accompaniment pattern data. Furthermore, the operations of step S63 etc. performed by the CPU 5 correspond to positions of one or more chords associated with beat positions being adjusted in accordance with a rhythm characteristic.

Referring back to FIG. 3, the musical passage information setting process (P5) is a process for setting musical passage information that serves as a basis for generating chord chart display data. As an example, the way to acquire such musical passage information to be set by the musical passage information setting process is selectable from two types of ways or options, i.e. "user setting" and "extraction from reference source data". At a time point when the musical passage information setting process is started, any one of the two types of ways to acquire musical passage information has already been selected and written in the necessary information storage region by the necessary information setting process (P2).

Upon startup of the musical passage information setting process, the CPU 5 determines at step S6 whether "user setting" is currently set as the way to acquire musical passage information. If "user setting" is currently selected as determined at step S6, the CPU 5 displays a musical passage setting screen (not shown) on the LCD of the display section 9. Once a user input is made on the musical passage setting screen, the CPU 5 receives the user input and writes the musical passage information, designated by the user input, into the musical passage information storage region to thereby set the musical passage information (step S6→step S7). In displaying the musical passage setting screen, the CPU 5 reflects currently-set musical passage information, if any, on the musical passage setting screen.

If "extraction from reference source data" is currently selected as determined at step S6, the CPU 5 performs a musical passage information generation process (step S6→step S8).

Figure 7:
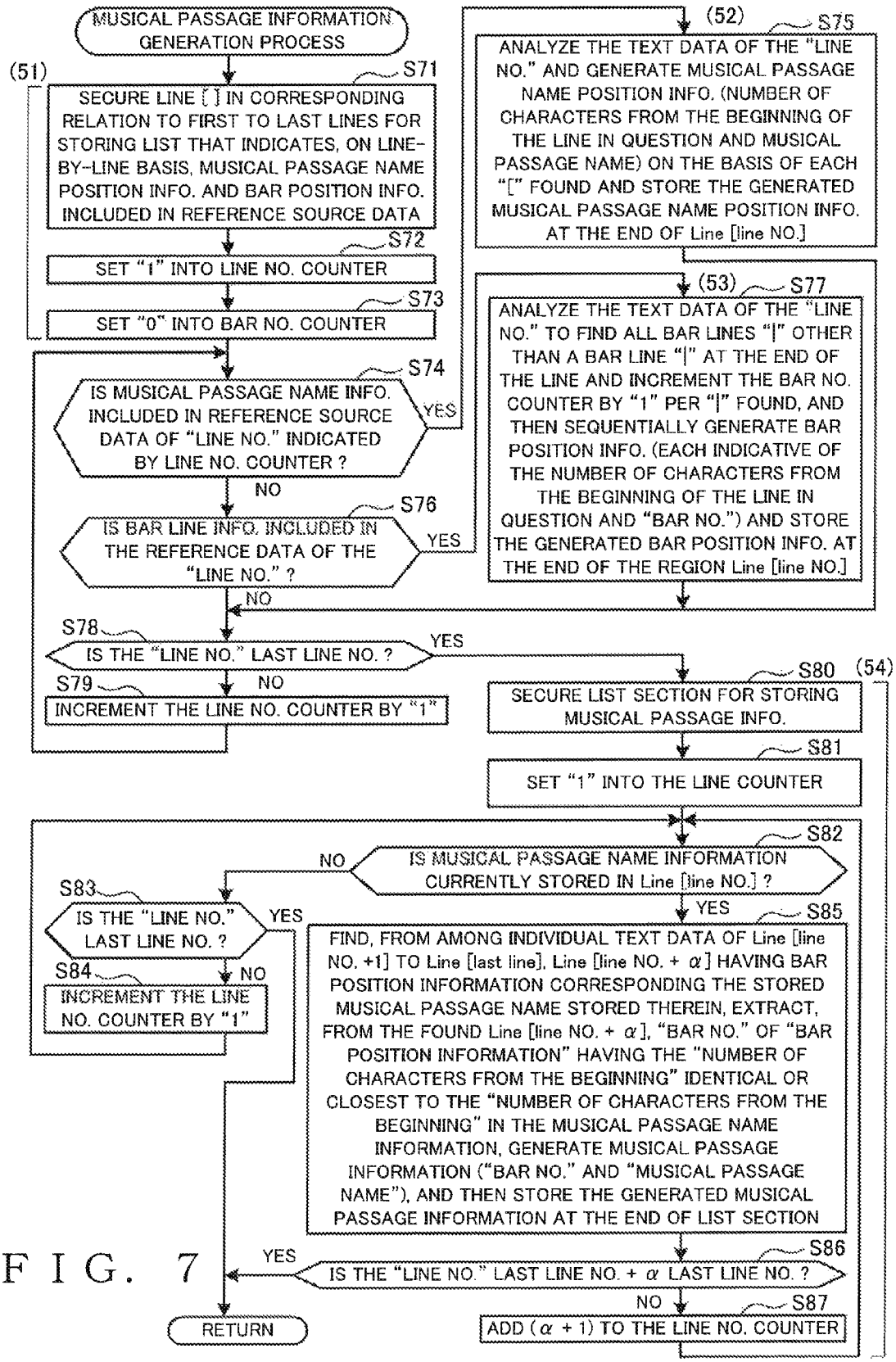
FIG. 7 is a flow chart showing a detailed operational sequence of a musical passage information generation process shown in FIG. 3.

FIG. 7 is a flow chart showing a detailed operational sequence of the musical passage information generation process. In the musical passage information generation process, information related to the musical information is extracted from among the "types of information to be added to chord chart display data to be generated" and registered into a list Section (not shown) secured in the RAM 7. Assuming now that "bar No." and "musical passage name" are currently set as the information related to the musical information, the "bar No." and "musical passage name" are generated by the musical passage information generation process. Note that the musical passage information generation process is an example of process using the reference source chord chart data 100*a* as the reference source data; namely, the musical passage information generation process does not operate appropriately for all possible reference source data.

The musical passage information generation process comprises mainly:

(51) an initialization process (steps S71 to S73);

(52) a musical passage name position information registration operation for generating musical passage name position information and registering the generated musical passage name position information into a region Line[ ] (step S75);

(53) a bar position information registration operation for generating bar position information and registering the generated bar position information into the region Line[ ] (step S77); and (54) a musical passage information registration process for generating musical passage information and registering the generated musical passage information into the list Section (steps S80 to S87).

Upon startup of the musical passage information generation process, the CPU 5 performs the initialization process (51) once and then performs the above-mentioned registration operations (52) and (53), per line from a first line to a last line of the reference source data, while incrementing the line No. by "1" at a time. Once the registration operations (52) and (53) on the last line are completed, the CPU 5 performs the registration operation (54) and then terminates the musical passage information generation process.

In the initialization process (51), the CPU 5 secures, in the RAM 7, regions (data arrays) Line[ ] in corresponding relation to the first to last lines for storing a list indicating, on a line-by-line basis, musical passage name position information and bar position information included in the reference source data, at step S71. Here, the "last line" can be obtained, for example, by analyzing the reference source data and counting "linefeeds". Because the musical passage name is indicated by character string data surrounded by "[" and "]" (see the supply source chord chart data 100*a* of FIG. 2), the musical passage name position information is generated as a set of the number of characters from the beginning of the line in question to "[" and a musical passage name (i.e., character string data indicative of the musical passage name), i.e. as "the number of characters from the beginning of the line in question and the musical passage name". Further, because the bar position information is indicated by "|" as noted above, it is generated as the a set of the number of characters from the beginning of the line in question to "|" and information indicative of how many "|"s there are from the first "|" in the reference source data to the "|" in question with "|" at the end of each line omitted (i.e., information indicative of a bar No), namely, as "the number of characters from the beginning of the line in question and the bar No.".

Next, at step S72, the CPU 5 secures, in the RAM 7, a line No. counter that is a software counter (count region) for counting line Nos., and then it sets a value "1" into the line No. counter. The No. indicated by the count value of the line No. counter will hereinafter be referred to as "line No.".

Further, at step S73, the CPU 5 secures, in the RAM 7, a bar No. counter that is a software counter (count region) for counting bar Nos. and then it sets a value "0" into the bar No. counter. The No. indicated by the count value of the bar No. counter will hereinafter be referred to as "bar No.". Because the bar No. counter is used for a different purpose from the bar No. counter used in the chord progression information setting process (P4), the two bar No. counters are secured in different regions of the RAM 7 although they are of the same name and function.

(51) Once the initialization process (51) is completed, the CPU 5 determines, at step S74, whether musical passage name information is included in text data, included in the reference source data, of the "line No." indicated by the line No. counter. Because the musical passage name information is character string data surrounded by "[" and "]", the determination at step S74 determines whether such character string data is included in text data, in the reference source data, of the "line No." indicated by the line No. counter. If such musical passage name information is included as determined at step S74, the CPU 5 proceeds to the musical passage name position information registration operation (52).

In the musical passage name position information registration operation (52), the CPU 5 analyzes the text data of the "line No." and generates musical passage name position information (number of characters from the beginning of the line in question and musical passage name) on the basis of each "[" found and stores the generated musical passage name position information at the end of the region Line[line No.], at step S75. Although a plurality of pieces of musical passage name information may sometimes be included in the text data of one line, let it be assumed here, for convenience of description, that only one piece of musical passage name information is included in the text data of one line.

If no musical passage name information is included as determined at step S74, the CPU 5 further determines, at step S76, whether bar line information is included in the text data of the "line No.". If bar line information is included in the text data of the "line No." as determined at step S76, the CPU 5 moves to the bar position information registration operation (53).

In the bar position information registration operation (53), the CPU 5 analyzes the text data of the "line No." to find all bar lines "|" other than a bar line "|" at the end of the line and increments the bar No. counter by "1" per "|" found, after which it sequentially generates bar position information (each indicative of the number of characters from the beginning of the line in question and bar No.) and stores the generated bar position information at the end of the region Line [line No.] (step S77).

If, on the other hand, no bar line information is included in the text data as determined at step S76, the CPU 5 further determines, at step S78, whether the "line No." is the last line No. If the "line No." is not the last line No. as determined at step S78, the CPU 5 increments the line counter by "1" at step S79 and then revers to step S74. But, if the "line No." is the last line No., on the other hand, the CPU 5 proceeds to the musical passage information registration operation (54).

In the musical passage information registration process (54), the CPU 5 secures the list Section in the RAM 7 at step S80 and sets "1" into the line No. counter at step S81.

Then, at step S82, the CPU 5 determines whether musical passage name information is currently stored in the region Line[line No.]. If no musical passage name information is currently stored in the region Line[line No.] as determined at step S82, the CPU 5 repeats the determination at step S82 while incrementing the line No. counter by "1" at a time (step S82→S83→S84→S82). Once the "line No." reaches the last line No. during the repetition of the determination at step S82, the CPU 5 terminates the musical passage information registration process (step S83→return).

If, on the other hand, musical passage name information is currently stored in the region Line[line No.] as determined at step S82, the CPU 5 finds, from among individual text data of Line[line No.+1] to Line[last line] the region Line[line NO.+$\alpha$] having bar position information corresponding the stored musical passage name stored therein, extracts, from the found region Line[line NO.+$\alpha$], a "bar No." of "bar position information" having the "number of characters from the beginning" identical or closest to the "number of characters from the beginning" in the musical passage name information, generates musical passage information ("bar No." and "musical passage name") and then stores the thus-generated musical passage information at the end of the list Section (step S85).

Then, the CPU 5 determines, at step S86, whether "line NO.+α" is the last line No. If "line NO.+α" is the last line No. as determined at step S86, the CPU 5 terminates the musical passage information generation process (step S86→return). If "line NO.+α" is not the last line No. as determined at step S86, on the other hand, the CPU 5 adds (α+1) to the count value of the line No. counter at step S87 and then reverts to step S82. In the case where the reference source chord data 100*a* is applied to the musical passage information generation process, (1, A) and (9, B) are registered into the list Section.

Referring now back to FIG. 3, the other information extraction process (P6) is a process for extracting other than the information related to musical passage information from among the "types of information to be added to chord chart display data to be generated" written in the necessary information storage region. In the other information extraction process, the CPU 5 extracts, from the reference source data and accompaniment style data, various information having been set as other information to be added to the chord display data. Specific examples of the other information extraction process have already been described in the outline of the control processing and will not be described here to avoid unnecessary duplication.

In the chord chart display data generation/display process (P7) (step S10 of FIG. 3), the CPU 5 generates chord chart display data on the basis of the chord progression information generated by the chord progression information setting process (P4), the musical time information set by the chord progression information setting process (P3), the musical passage information set by the musical passage information setting process (P5) and the other additional information extracted by the other information extraction process (P6). Then, the CPU 5 not only stores the generated chord chart display data into the chord chart display data storage region but also displays the generated chord chart display data on the LCD of the display section 9. The chord chart 9*a* of FIG. 2 shows an example of chord chart display data generated on the basis of the reference source chord chart data 100*a* and the accompaniment style data 10*a*. Note that arrangements may be made such that the chord progression information, musical time information, musical passage information, etc. of the chord chart display data displayed on the LCD of the display section 9 can be modified by the user on the display screen. The process of step S10 performed by the CPU 5 corresponds to providing a chord chart display on the basis of the generated chord progression information.

In the automatic accompaniment data generation/reproduction process (P8), the CPU 5 generates automatic accompaniment data on the basis of the generated chord progression information, selected and set accompaniment style data, etc. (step S12 of FIG. 3), stores the generated automatic accompaniment data into the automatic accompaniment data automatic accompaniment data storage region and outputs the generated automatic accompaniment data to the sequencer so that the automatic accompaniment data is reproduced via the sequencer (step S13 of FIG. 3). In the case where automatic accompaniment data is generated on the basis of the reference source chord chart data 100*a* and the accompaniment style data 10*a*, automatic accompaniment data is generated, for example, such that reproduction of the automatic accompaniment data is executed in the operational sequence 7*a*. Although the way to generate the automatic accompaniment data has already been described in the outline of the control processing and thus will not be described here to avoid unnecessary duplication, the following describe a data format of the automatic accompaniment data to be generated. As an example, the automatic accompaniment data comprises data defining accompaniment pattern data of which one of a plurality of sections constituting set accompaniment style data is to be used for a performance (reproduction), in which order the accompaniment style data are to be performed (played), chords (chord sequence) of which bar of generated chord progression information are to be used for performance of accompaniment pattern data of which one of the sections, and so on. Therefore, although it is assumed in the instant embodiment that the accompaniment pattern data is of the MIDI format, the automatic accompaniment data itself is not of the MIDI format. The sequencer generates performance data (event data) by reproducing the automatic accompaniment data of such a data format, i.e. on the basis of the accompaniment pattern data defined by the reproduced automatic accompaniment data, and outputs the performance data to the tone generator/effect circuit 12. In this case, a chord progression in the automatic accompaniment data is expressed on the basis of a predetermined reference musical key (e.g., key of C), and thus, it is possible to readily execute an appropriate automatic accompaniment by converting the chord progression in the automatic accompaniment data into individual chords in accordance with specific chord information generated according to the principles of the present invention. Note that, because the reproduction process to be performed by the sequencer on the automatic accompaniment data is not a feature of the present invention and may be performed in the conventionally-known manner, description about the reproduction process is omitted here.

Briefly stated, the operation of step S12 performed by the CPU 5 corresponds to generating automatic accompaniment data by controlling the chord progression of the acquired accompaniment pattern data in accordance with the generated chord progression information.

In the automatic accompaniment data generation/reproduction process (P8), generated automatic accompaniment data is reproduced promptly after the generation. Alternatively, a reproduction (play) start switch (not shown) may be provided in the group of setting operators 2 so that reproduction is started in response to a user's turning-on operation of the reproduction start switch. In this case, it is preferable that a reproduction (play) stop switch (not shown) too be provided so that the user can freely stop the reproduction.

In the storage process (P9), of the generated chord chart display data and automatic accompaniment data, i.e. the chord chart display data stored in the chord chart display storage region and the automatic accompaniment data stored in the automatic accompaniment data storage region, the CPU 5 stores data, for which the user has instructed storage, for example into the storage device 10 after assigning respective names to the data.

Whereas the chord chart display data/automatic accompaniment data generation processing is described here as incapable of being terminated half way through just for simplicity of description, an end switch (not shown) may be provided in the group of setting operators 2 so that, in response to the user turning on the end switch, the chord chart display data/automatic accompaniment data generation processing can be terminated following a predetermined termination process. A similar process to the storage process (P9) may be performed as the termination process.

Whereas the instant embodiment has been described in relation to the case where automatic accompaniment data using accompaniment style data is generated as an example form of music data generation, the present invention is not so limited. For example, the basic principles of the present invention are also applicable to a case where a rhythm template (or pattern data) is provided and arrangement data is generated on the basis of the rhythm template and using musically-harmonizing pitches, such as chord component sounds, with reference to acquired chord progression information, and to a case where musical score data with chord names is generated by acquiring a melody score and chord chart of a user-preferred music piece.

Furthermore, whereas the instant embodiment has been described in relation to the case where accompaniment pattern data included in accompaniment style data (sections) is of the MIDI format, the accompaniment pattern data may be data of an audio format (audio waveform data) or may include data of an audio format in some of performance parts. In the case where audio waveform data is used as the accompaniment pattern data, sound generation timing of notes may be extracted using a conventionally-known waveform analysis technique.

Further, the format of chord chart data (reference source data) is not limited to that employed in the above-described embodiment. For example, although the bar line is usually indicated by the "|" mark, it may be indicated by any other suitable mark than "|". Furthermore, whereas each chord name is expressed by a chord root indicated by an uppercase alphabetical letter and a chord type indicated by a combination a lower-case alphabetical letter and a numeral, the chord type may be indicated, for example, by katakana (Japanese syllabary). Alternatively, in a case where musical key information is included, a chord may be expressed by a degree name in frequency notation, in which case a chord may be converted at the time of acquisition of chord information.

Furthermore, whereas the embodiment has been described above in relation to the case where reference source data is resident in a server (web site) on the Internet, reference source data may be prestored in the embodiment of the music data generation apparatus, i.e. in the ROM 6 or storage device 10 of the music data generation apparatus.

Furthermore, whereas the embodiment has been described above in relation to the case where time information (sound generation timing) of chord information is a reproduction (play) time itself taking a tempo into account, the present invention is not so limited, and the time information (sound generation timing) of chord information may be a relative time, such as a first beat in a first bar, whose reproduction time varies depending on a reproduction tempo.

Furthermore, whereas the above-described embodiment is not constructed to allow the user to edit/update a chord chart to be referenced, the present invention may be constructed to allow the user to edit/update a chord chart prior to generation of chord progression information.

The way to acquire musical time information may be other than the ones employed in the above-described embodiment; for example, musical time information may be acquired from original musical score data or music piece data that is to be used as a melody or other performance part, or may be acquired by analyzing basic music piece data (MIDI/audio data) or by referencing a table, defining relationship between genres and musical times, by designating a genre.

Furthermore, the way to cause the sound generation timing of each chord information to match a beat position may be other than the one employed in the above-described embodiment; for example, music piece data (including accompaniment pattern data of accompaniment style data) serving a basis as input information for music data generation may be analyzed to extract bar lines and beat positions so as to cause the sound generation (reproduction) timing (i.e., chord change timing) of each chord information to match any one of the extracted beat positions.

Furthermore, music data to be generated using chord progression information generated from chord chart data may be other than the one described above in relation to the embodiment; for example, the music data to be generated may be a musical score or arrangement data having chord names added to original music piece data corresponding to a chord chart. Among other possible examples of the music data to be generated are data of a musical score or tablature indicating chords with reference to a chord chart, a chord chart with chord types indicated in katakana (Japanese syllabary), a chord chart converted (assuming a musical time) so as to include as many tensions as possible or converted so that all chords fall within the range of diatonic chords and secondary dominant chords.

Although the above description about the embodiment did not refer to editing, by the user, of the generated music data, extracted chord progression information and musical passage information and set musical time information, the present invention may be constructed to permit editing, by the user, of the generated music data, extracted chord progression information and musical passage information and set musical time information.

Whereas the embodiment has been described above as setting or acquiring musical passage information in accordance with a particular way set to acquire musical passage information, the present invention is not so limited; for example, musical passage information may be acquired from text data in a case where the musical passage information is included in reference source data. Alternatively, in a case where no musical passage mark is included in reference source data, musical passage information may be automatically extracted by analyzing chord progression information extracted from the reference source data. As one possible example, provisional musical passage information is generated on a four-bar-by-four-bar basis, a comparison is made between chord progressions of adjoining four-bar sections, and these provisional musical passage information is organized into one musical passage if the compared chord progressions match each other over three or more bars from the beginning of the four-bar section. The musical passage information is stored with uppercase or capital letters "A", "B", "C", sequentially added thereto and in association with start bar positions (or timing information). Further, as another example of the way to acquire musical passage information, a repeated structure of a melody may be found on the basis of combinations of types of component notes (twelve-tone scale vectors), rather than chord names, in the chord progression comparison. For example, in a case where "chord progression 1" comprises |Dm7 G7| and "chord progression 2" comprises |Dm7 D♭7 (substitute chord for G7)|, a repeated structure of a melody can be detected with an increased accuracy by employing a comparison as to whether component notes in a twelve-tone scale are similar between "chord progression 1" and "chord progression 2", because "chord progression 1" and "chord progression 2" are considerably similar even though the two chord progressions do not match each other in chord name.

Furthermore, as the way to acquire musical passage information, there may be employed an option of "estimation from a chord progression" in addition to the options employed in the embodiment. In such a case, there may be employed an approach of, for example, "dividing at each section where no chord is included" or "converting, into one section, sections where a same chord progression is repeated".

Furthermore, whereas the embodiment has been described above in relation to the case where music content data, such as accompaniment style data and phrase data serving as a basis of generation of music data are stored in the storage device 10 of the music data generation apparatus, the present invention is not so limited, and such music content data may be acquired and referenced via a communication network.

Moreover, the embodiment has been described above as not assuming a case where no musical passage information has been extracted. In such a case, the present invention may be arranged to use a default section, such as "Main A" section, when generating automatic accompaniment data as music data.

Furthermore, the variables, data arrays, lists, etc. employed in the above-described embodiment are only illustrative examples, and it should be appreciated that the present invention can achieve advantageous benefits similar to the above even with other desired data structures and algorithms.

Furthermore, in a case where music data to be generated is electronic musical score data, chord progression information obtained by analyzing original text data may be converted into a desired format, such as MusicXML, or converted into a MIDI file of an XF format.

Furthermore, because reference source text data come in various formats, it is preferable that they be converted, prior to extraction of chord progression information or the like, into one format as in the above-described embodiment. The above description about the embodiment has made no reference to how reference source text data is referenced, because a style of reference varies depending on a manner in which a server supplies reference source text data to the music data generation apparatus. Typically, because text data is of relatively small quantity, text data downloaded from a server is referenced after storage into the RAM 7 or the like. However, in a case where a server delivers data in such a manner that, after a portion of data delivered by the server is used, the server delivers a next portion of the data as in so-called streaming, i.e. that all of the delivered data is not left in the RAM 7, the delivered portion of data is used as reference source text data.

Moreover, whereas the embodiment has been described above as extracting mainly chord information, bar line information and musical passage information, the present invention may be constructed to extract, in addition to the above, a title and composer's name of a music piece and musical symbols (rehearsal mark, repetition mark, BPM (Beats Per Minute), key information, etc.). Where musical symbols are extracted, it is necessary to extract corresponding bar position information. Each of such information can be extracted in a similar manner to a process for extracting chord information etc., as long as the information to be extracted is in a predetermined text format.

It should be appreciated that the object of the present invention can also be accomplished by supplying a system or apparatus with a storage medium having stored therein program codes of software implementing the functions of the above-described embodiment so that a computer (e.g., CPU, MPU or the like) of the system or apparatus reads out and executes the program codes stored in the storage medium.

In such a case, the program codes read out from the storage medium themselves implement the functions of the present invention, and these program codes and the storage medium having stored therein the program codes together implement the present invention.

Furthermore, the storage medium for supplying the program codes may be, for example, a flexible disk, hard disk, magneto-optical disk, CD-ROM, CD-R, CD-RW, DVD-ROM, DVD-RAM, DVD-RW, DVD+RW, magnetic tape, non-volatile memory card, ROM or the like. As an alternative, the program codes may be downloaded from a server computer via a communication network.

Moreover, whereas the functions of the above-described embodiment of the present invention have been described above as implemented by a computer reading out and executing the program codes, they may of course be implemented by an OS (operating system) and the like, running on the computer, performing a part or whole of the actual processing on the basis of the instructions of the program codes.

Furthermore, needless to say, the program codes, read out from the storage medium, may be written into a memory provided on a function extension board inserted in the computer or on a function extension unit connected to the computer so that the functions of the above-described embodiment can be implemented by a CPU and the like, provided on the function extension board or the function extension unit, performing a part or whole of the actual processing on the basis of the instructions of the program codes.

This application is based on, and claims priority to, JP PA 2013-210923 filed on 8 Oct. 2013. The disclosure of the priority application, in its entirety, including the drawings, claims, and the specification thereof, are incorporated herein by reference.

What is claimed is:

1. A music data generation apparatus comprising:

a processor; and a memory storing computer code that, when executed by the processor, causes the apparatus to:

acquire text-based data representative of a chord progression;

acquire musical meter information indicative of a musical meter of music data to be generated;

extract individual chords and bar lines from the acquired text-based data; and generate chord progression information by allocating in-bar relative time positions to the extracted individual chords in accordance with the musical meter indicated by the acquired musical meter information and the extracted bar lines.

2. The music data generation apparatus as claimed in claim 1, wherein the computer code, when executed by the processor, further causes the apparatus to provide a chord chart display based on the generated chord progression information.

3. The music data generation apparatus as claimed in claim 1, wherein the computer code, when executed by the processor, further causes the apparatus to:

acquire accompaniment pattern data corresponding to the acquired text-based data; and generate automatic accompaniment data by controlling the acquired accompaniment pattern data in accordance with the generated chord progression information.

4. The music data generation apparatus as claimed in claim 3, wherein the in-bar relative time positions to be allocated to the extracted individual chords are adjusted in accordance with sound generation timing of accompaniment sounds indicated by the accompaniment pattern data.

5. The music data generation apparatus as claimed in claim 1, wherein the in-bar relative time positions to be allocated to the extracted individual chords are beat positions.

6. The music data generation apparatus as claimed in claim 1, wherein the computer code, when executed by the processor, further causes the apparatus to extract musical passage information from the acquired text-based data, and wherein the extracted musical passage information is added to the music data to be generated.

7. The music data generation apparatus as claimed in claim 3, wherein the computer code, when executed by the processor, further causes the apparatus to:

extract musical passage information from the acquired text-based data; and control the acquired accompaniment pattern data in accordance with the extracted musical passage information, and wherein the automatic accompaniment data is generated on the basis of the accompaniment pattern data controlled in accordance with the generated chord progression information and the extracted musical passage information.

8. The music data generation apparatus as claimed in claim 1, wherein, in order to allocate the in-bar relative time positions to the extracted individual chords, the computer code, when executed by the processor, causes the apparatus to:

position one or more chords, present in a bar, at an interval corresponding to a number of the chords in the bar; and correct a position of a chord, which is among the one or more chords positioned at the interval corresponding to the number of the chords and which does not corresponds to a beat position, so as to be associated with a beat position.

9. The music data generation apparatus as claimed in claim 8, wherein said extracting individual chords and bar lines from the acquired text-based data includes extracting a blank mark from the text-based data, and said positioning one or more chords, present in a bar, at an interval corresponding to a number of the chords in the bar includes adjusting the interval between the chords in accordance with presence of the blank mark.

10. The music data generation apparatus as claimed in claim 8, wherein, in order to allocate the in-bar relative time positions to the extracted individual chords, the computer code, when executed by the processor, causes the apparatus to adjust positions of the one or more chords associated with the beat positions in accordance with a rhythm characteristic.

11. A computer-implemented method comprising:

acquiring text-based data representative of a chord progression;

acquiring musical meter information indicative of a musical meter of music data to be generated;

extracting individual chords and bar lines from the acquired text-based data; and generating chord progression information by allocating in-bar relative time positions to the extracted individual chords in accordance with the musical meter indicated by the acquired musical meter information and the extracted bar lines.

12. A non-transitory computer-readable storage medium containing a group of instructions executable by a processor to perform a music data generation method, said method comprising:

acquiring text-based data representative of a chord progression;

acquiring musical meter information indicative of a musical meter of music data to be generated;

extracting individual chords and bar lines from the acquired text-based data; and generating chord progression information by allocating in-bar relative time positions to the extracted individual chords in accordance with the musical meter indicated by the acquired musical meter information and the extracted bar lines.

* * * * *